US009862184B2

(12) United States Patent
Abe

(10) Patent No.: US 9,862,184 B2
(45) Date of Patent: Jan. 9, 2018

(54) LIQUID EJECTING APPARATUS, DRIVE CIRCUIT, AND HEAD UNIT

(71) Applicant: Seiko Epson Corporation, Tokyo (JP)

(72) Inventor: Akira Abe, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/288,098

(22) Filed: Oct. 7, 2016

(65) Prior Publication Data

US 2017/0113458 A1 Apr. 27, 2017

(30) Foreign Application Priority Data

Oct. 26, 2015 (JP) ..... 2015-209942

(51) Int. Cl.
*B41J 2/045* (2006.01)

(52) U.S. Cl.
CPC ..... *B41J 2/04541* (2013.01); *B41J 2/04581* (2013.01); *B41J 2/04588* (2013.01); *B41J 2/04593* (2013.01); *B41J 2/04596* (2013.01)

(58) Field of Classification Search
CPC ..... B41J 2/04541; B41J 2/04596; B41J 2/04593; B41J 2/04588; B41J 2/04581; B41J 29/38; B41J 29/393
See application file for complete search history.

(56) References Cited

U.S. PATENT DOCUMENTS 9,421,762 B1 * 8/2016 Abe ..... B41J 2/04588
9,550,356 B2 * 1/2017 Shima ..... B41J 2/04541
2001/0026292 A1 * 10/2001 Ishizaki ..... B41J 2/04541 347/12
2007/0165074 A1 * 7/2007 Ishizaki ..... B41J 2/0452 347/57
2009/0206888 A1 8/2009 Kitazawa et al.
2010/0321439 A1 * 12/2010 Kanno ..... B41J 2/04541 347/17
2014/0285553 A1 * 9/2014 Otsuka ..... B41J 2/04588 347/11
2015/0062207 A1 * 3/2015 Abe ..... B41J 2/04541 347/5
2016/0167367 A1 * 6/2016 Takagi ..... B41J 2/04551 347/10
2017/0087831 A1 * 3/2017 Shima ..... B41J 2/04586

FOREIGN PATENT DOCUMENTS

JP 2009-190287 A 8/2009
JP 2010-114711 A 5/2010

* cited by examiner

*Primary Examiner* — Patrick King
(74) *Attorney, Agent, or Firm* — Harness, Dickey & Pierce, P.L.C.

(57) ABSTRACT

A liquid ejecting apparatus includes an ejecting unit that includes a piezoelectric element which is displaced by application of a drive signal and ejects liquid according to displacement of the piezoelectric element; a comparison unit that includes a first comparator and a second comparator, receives an input signal and a feedback signal based on the drive signal, and outputs a first control signal and a second control signal; a pair of transistors that is configured by a first transistor which is controlled based on the first control signal and a second transistor which is controlled based on the second control signal, and outputs the drive signal from a coupling point of the first transistor and the second transistor; an output capacitor that has one terminal coupled to the coupling point; and a differentiation and integration circuit.

10 Claims, 14 Drawing Sheets

<DECODED CONTENT OF DECODER>

| | PRINT DATA SI | T1 | | T2 | |
|---|---|---|---|---|---|
| | | Sa | Sb | Sa | Sb |
| LARGE DOT | (1, 1) | H | L | H | L |
| MEDIUM DOT | (0, 1) | H | L | L | H |
| SMALL DOT | (1, 0) | L | L | L | H |
| NO RECORD | (0, 0) | L | H | L | L |

MSB LSB

<GAIN CHARACTERISTICS>

LIQUID EJECTING APPARATUS, DRIVE CIRCUIT, AND HEAD UNIT

The entire disclosure of Japanese Patent Application No. 2015-209942, filed Oct. 26, 2015 is expressly incorporated by reference herein.

BACKGROUND

1. Technical Field

The present invention relates to a liquid ejecting apparatus, a drive circuit, and a head unit.

2. Related Art

An apparatus which uses a piezoelectric element (for example, a piezo element) is known as an ink jet printer which prints an image or a document by ejecting ink. Piezoelectric elements are provided in correspondence with each of multiple nozzles in a head unit, each of the piezoelectric elements is driven in accordance with a drive signal, and thus, a predetermined amount of ink (liquid) is ejected from the nozzle at a predetermined timing to form dots. The piezoelectric element is a capacitive load such as a capacitor from a viewpoint of electricity, and needs to receive a sufficient current in order to operate the piezoelectric elements of each nozzle.

For this reason, an original drive signal is amplified by an amplification circuit, is supplied to a head unit as a drive signal, and drives the piezoelectric elements. It is recommended that an amplification circuit uses a method (linear amplification, refer to JP-A-2009-190287) of current-amplifying the original drive signal in an AB class or the like. However, since power consumption increases and energy efficiency decreases in the linear amplification, a D-class amplification is also proposed in recent years (refer to JP-A-2010-114711). In short, in a D-class amplification, a pulse width modulation or a pulse density modulation of an input signal is performed, a high side transistor and a low side transistor that are inserted in series between power supply voltages are switched in accordance with the modulated signal, an output signal which is generated by the switching is filtered by a low pass filter, and thus, the input signal is amplified.

However, energy efficiency of a D-class amplification method is higher than that of a linear amplification method, power which is consumed by a low pass filter cannot be ignored, and thus, there is room for improvement in terms of reducing power consumption.

SUMMARY

An advantage of some aspects of the invention is to provide a liquid ejecting apparatus, a drive circuit, and a head unit which reduce power consumption.

A liquid ejecting apparatus according to an aspect of the invention includes an ejecting unit that includes a piezoelectric element which is displaced by application of a drive signal and ejects liquid according to displacement of the piezoelectric element; a comparison unit that includes a first comparator and a second comparator, receives an input signal and a feedback signal based on the drive signal, and outputs a first control signal and a second control signal; a pair of transistors that is configured by a first transistor which is controlled based on the first control signal and a second transistor which is controlled based on the second control signal, and outputs the drive signal from a coupling point of the first transistor and the second transistor; an output capacitor that has one terminal coupled to the coupling point; and a differentiation and integration circuit that drops a voltage of the feedback signal and outputs a signal which is obtained by making a phase progress over a predetermined frequency band, as the feedback signal, in which the first comparator compares a first comparison signal with a second comparison signal and outputs the first control signal, in which the first comparison signal is a signal that is obtained by offsetting one of the input signal and the feedback signal, in which the second comparator compares a third comparison signal with a fourth comparison signal and outputs the second control signal, and in which the third comparison signal is a signal that is obtained by offsetting one of the input signal or the feedback signal.

According to the liquid ejecting apparatus of the aspect, it is possible to reduce power consumption, to reduce a possibility of abnormal oscillation, and to reduce capacitance of an output capacitor. In addition, by reducing the capacitance of the output capacitor, power can be prevented from being wastefully consumed.

In the liquid ejecting apparatus according to the aspect, the differentiation and integration circuit may include a first resistor, a second resistor, a first capacitor, and a second capacitor, the first resistor and the second capacitor may be electrically coupled in parallel with each other between an output node of the drive signal and an input node of the feedback signal to the comparison unit, and the second resistor and the first capacitor may be electrically coupled in parallel with each other between the input node and a power supplying line with a predetermined potential.

The first resistor and the second resistor include a function of dropping a voltage of the drive signal and a function of compensating for a phase delay, and thus, it is possible to simplify a configuration rather than configurations in which the both functions are separately included.

In the liquid ejecting apparatus according to the aspect, the first resistor may have a resistance value greater than a resistance value of the second resistor.

In addition, a buffer amplifier may be provided between the output node and the first resistor, and the buffer amplifier may multiply a voltage of the output node by a predetermined coefficient and supply the voltage of the multiplied value to the first resistor. It is possible to prevent the voltage of the output node from decreasing due to leakage through the first resistor and the second resistor.

In the liquid ejecting apparatus according to the aspect, the second comparison signal may be a signal that is obtained by offsetting the other of the input signal or the feedback signal by a voltage including zero, and the fourth comparison signal may be a signal that is obtained by offsetting the other of the input signal or the feedback signal by a voltage including zero.

In addition, in the liquid ejecting apparatus according to the aspect, the first transistor and the second transistor may be field effect transistors.

The liquid ejecting apparatus according to the aspect may further includes a first offset unit that decreases the input signal by a first voltage, or increases the feedback signal by the first voltage; and a second offset unit that increases the input signal by a second voltage, or decreases the feedback signal by the second voltage.

In the liquid ejecting apparatus according to the aspect, the first comparator may set the first control signal as a signal which turns on the first transistor, if a voltage of the feedback signal is lower than a voltage which is obtained by subtracting a voltage of the input signal by the first voltage, and the second comparator may set the second control signal as a signal which turns on the second transistor, if the voltage of the feedback signal is equal to or higher than a voltage which is obtained by adding the second voltage to the voltage of the input signal.

According to the configuration, if the voltage of the feedback signal is equal to or higher than the voltage which is obtained by subtracting the voltage of the input signal by the first voltage and is lower than the voltage which is obtained by adding the second voltage to the voltage of the input signal, both the first transistor and the second transistor are turned off.

The liquid ejecting apparatus may eject liquid, and includes a three-dimensional shaping apparatus (so-called 3D printer), a textile printing apparatus, or the like, in addition to a printing device which will be described below.

In addition, the invention is not limited to a liquid ejecting apparatus, can be realized in various aspects, and can be conceptualized as a drive circuit which drives a capacitive load such as the piezoelectric element, a head unit of a liquid ejecting apparatus, or the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a printing apparatus according to an embodiment of the invention will be described as an example with reference to the drawings.

Figure 1:
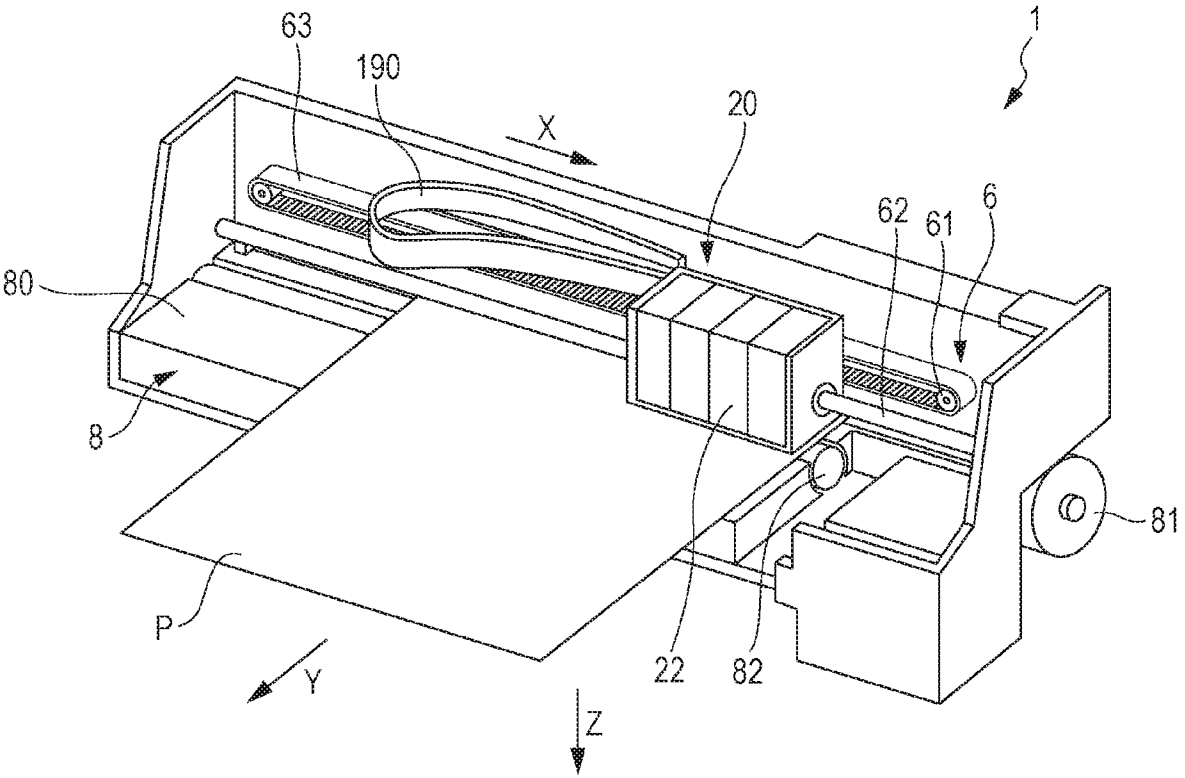
FIG. 1 is a view illustrating a schematic configuration of a printing apparatus according to an embodiment.

FIG. 1 is a perspective view illustrating a schematic configuration of a printing apparatus.

A printing apparatus 1 is a type of a liquid ejecting apparatus which forms an ink dot group on a medium P such as paper by ejecting ink as liquid, and thereby printing an image (including characters, graphics, or the like).

As illustrated in FIG. 1, the printing apparatus 1 includes a moving mechanism 6 which moves (moves back and forth) a carriage 20 in a main scanning direction (X direction).

The moving mechanism 6 includes a carriage motor 61 which moves the carriage 20, a carriage guide axis 62 both of which are fixed, and a timing belt 63 which extends substantially parallel to the carriage guide axis 62 and is driven by the carriage motor 61.

The carriage 20 is supported by the carriage guide axis 62 so as to move freely back and forth, and is fixed to a part of the timing belt 63. For this reason, if the timing belt 63 travels forward and backward by the carriage motor 61, the carriage 20 is guided by the carriage guide axis 62 and moves back and forth.

A printing head 22 is mounted in the carriage 20. The printing head 22 includes multiple nozzles which respectively eject ink in the Z direction onto a portion which faces the medium P. The printing head 22 is divided into approximately four blocks for color printing. The multiple blocks respectively eject black (Bk) ink, cyan (C) ink, magenta (M) ink, and yellow (Y).

There is provided a configuration in which various control signals or the like, which include a drive signal from a main substrate (omitted in FIG. 1) through a flexible flat cable 190, are supplied to the carriage 20.

The printing apparatus 1 includes the medium P and a transport mechanism 8 which transports the printing head on a platen 80. The transport mechanism 8 includes a transport motor 81 which is a drive source, and a transport roller 82 which is rotated by the transport motor 81 and transports the medium P in a sub-scanning direction (Y direction).

In the configuration, an image is formed on a surface of the medium P by ejecting ink in response to print data from the nozzles of the printing head 22 in accordance with main scanning of the carriage 20, and repeating an operation of transporting the medium P in accordance with the transport mechanism 8.

In the present embodiment, the main scanning is performed by moving the carriage 20, but may be performed by moving the medium P, and may be performed by moving both the carriage 20 and the medium P. The point is that there may be provided a configuration in which the medium P and the carriage 20 (printing head 22) move relatively.

Figure 2A:
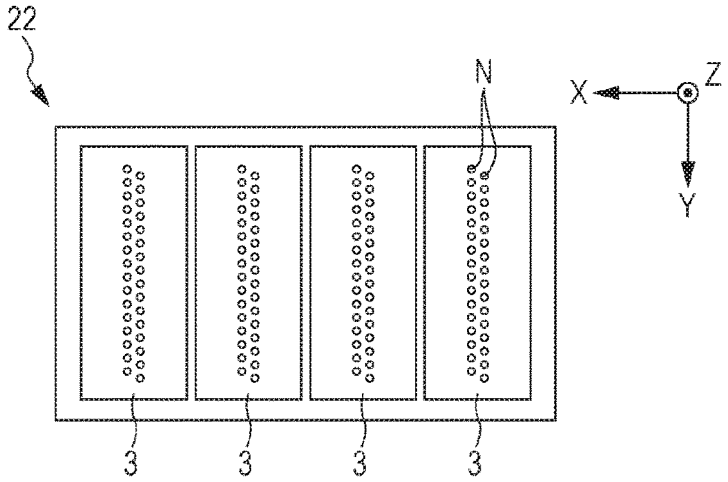
FIG. 2A is a diagram illustrating arrangement or the like of nozzles in a head unit.

FIG. 2A is a diagram illustrating a configuration in a case in which an ejecting surface of ink in the printing head 22 is viewed from the medium P. As illustrated in FIG. 2A, the printing head 22 includes four head units 3. The four head units 3 are arranged in the X direction which is a main scanning direction in correspondence with black (Bk), cyan (C), magenta (M), and yellow (Y), respectively.

Figure 2B:
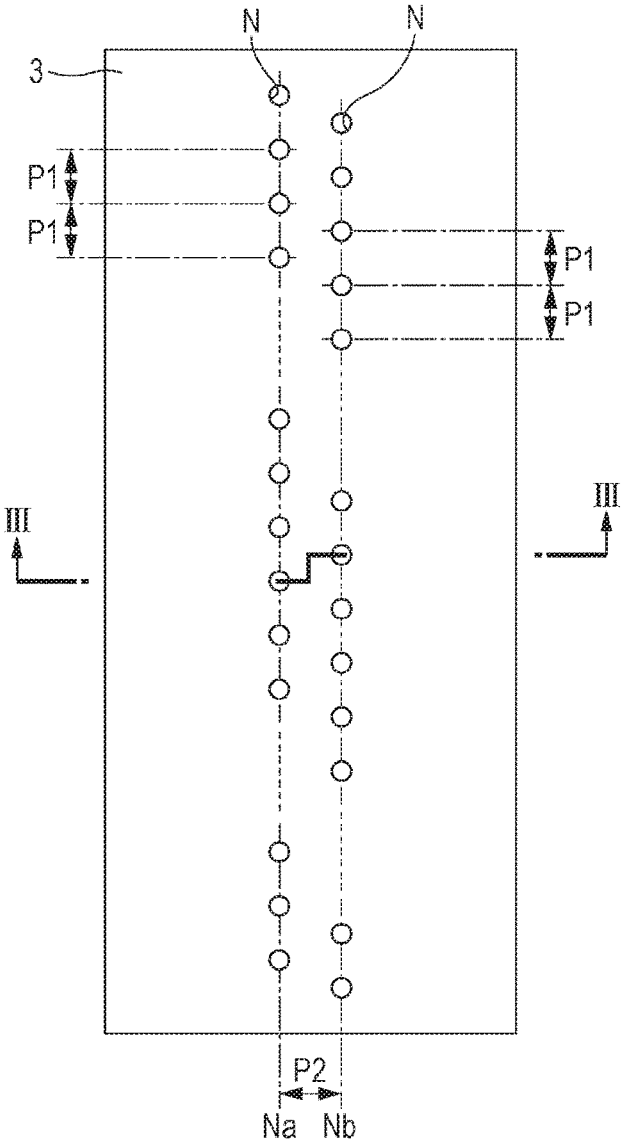
FIG. 2B is a diagram illustrating arrangement or the like of the nozzles in the head unit.

FIG. 2B is a diagram illustrating arrangement of nozzles in one head unit 3.

As illustrated in FIG. 2B, multiple nozzles N are arranged in two columns in one head unit 3. For the sake of convenience, the two columns are respectively referred to as a nozzle column Na and a nozzle column Nb.

Multiple nozzles N are respectively arranged in the Y direction by a pitch P1 in the nozzle columns Na and Nb. In addition, the nozzle columns Na and Nb are separated from each other by a pitch P2 in the Y direction. The nozzles N in the nozzle column Na are shifted from the nozzles N in the nozzle column Nb by half of the pitch P1 in the Y direction.

In this way, the nozzles N are arranged so as to be shifted by half of the pitch P1 in the two columns of the nozzle columns Na and Nb in the Y direction, and thereby it is possible to increase resolution in the Y direction substantially twice as much as a case of one column.

The number of nozzles N in one head unit 3 is referred to as m (m is an integer greater than or equal to 2) for the sake of convenience.

In the head unit 3, a flexible circuit board is connected to an actuator substrate, and a drive IC is mounted on the flexible circuit board. Next, a structure of the actuator substrate will be described.

Figure 3:
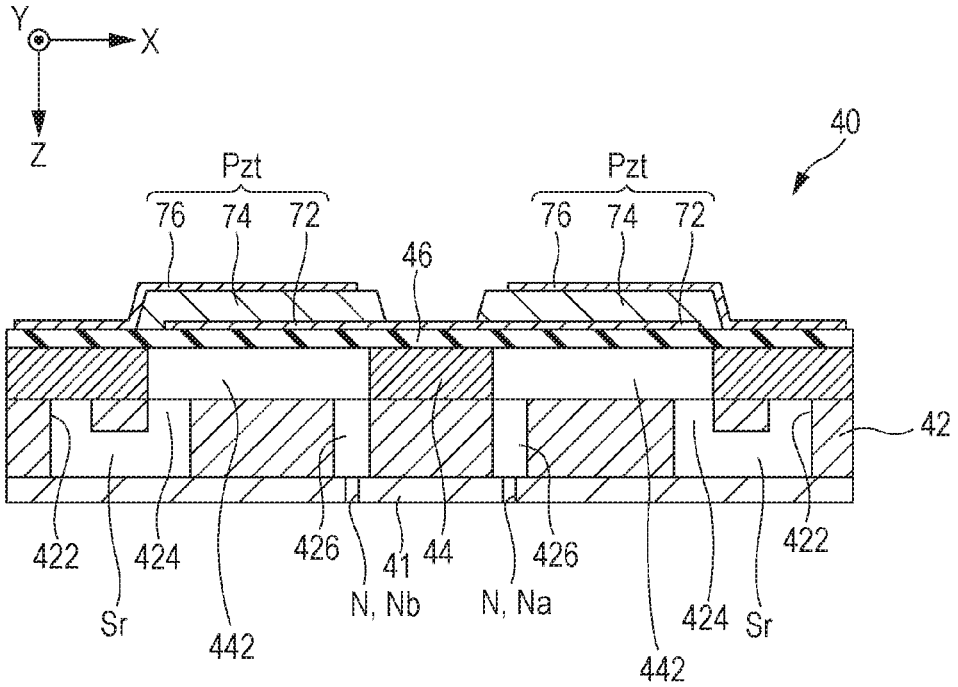
FIG. 3 is a sectional view illustrating an essential configuration of the head unit.

FIG. 3 is a sectional view illustrating a structure of the actuator substrate. In detail, FIG. 3 is a view illustrating a cross section taken along line III-III of FIG. 2B.

As illustrated in FIG. 3, the actuator substrate 40 has a structure in which a pressure chamber substrate 44 and a vibration plate 46 are provided on a surface on a negative side in the Z direction and a nozzle plate 41 is provided on a surface on a positive side in the Z direction, in a flow path substrate 42.

Schematically, each element of the actuator substrate 40 is a member of an approximately flat plate which is long in the Y direction, and is fixed to each other using, for example, an adhesive. In addition, the flow path substrate 42 and the pressure chamber substrate 44 are formed by, for example, a single crystal substrate of silicon.

The nozzles N are formed in the nozzle plate 41. A structure corresponding to the nozzles in the nozzle column Na is shifted from a structure corresponding to the nozzles in the nozzle column Nb by half of the pitch P1 in the Y direction, but the nozzles are formed approximately symmetrically except for that, and thus, the structure of the actuator substrate 40 will be hereinafter described by focusing on the nozzle column Na.

The flow path substrate 42 is a flat member which forms a flow path of ink, and includes an opening 422, a supply flow path 424, and a communication flow path 426. The supply flow path 424 and the communication flow path 426 are formed in each nozzle, and the opening 422 is continuously formed over the multiple nozzles and has a structure in which ink with a corresponding color is supplied. The opening 422 functions as a liquid reservoir chamber Sr, and a bottom surface of the liquid reservoir chamber Sr is configured by, for example, the nozzle plate 41. In detail, the nozzle plate 41 is fixed to the bottom surface of the flow path substrate 42 so as to close the opening 422, the supply flow path 424, and the communication flow path 426 which are in the flow path substrate 42.

The vibration plate 46 is installed on a surface on a side opposite to the flow path substrate 42, in the pressure chamber substrate 44. The vibration plate 46 is a member of an elastically vibratile flat plate, and is configured by stacking an elastic film formed of an elastic material such as a silicon oxide, and an insulating film formed of an insulating material such as a zirconium oxide. The vibration plate 46 and the flow path substrate 42 face each other with an interval in the inner side of each opening 422 of the pressure chamber substrate 44. A space between the flow path substrate 42 and the vibration plate in the inner side of each opening 422 functions as a cavity 442 which provides pressure to ink. Each cavity 442 communicates with the nozzle N through the communication flow path 426 of the flow path substrate 42.

A piezoelectric element Pzt is formed in each nozzle N (cavity 442) on a surface on a side opposite to the pressure chamber substrate 44 in the vibration plate 46.

The piezoelectric element Pzt includes a common drive electrode 72 formed over the multiple piezoelectric elements Pzt formed on a surface of the vibration plate 46, a piezoelectric body 74 formed on a surface of the drive electrode 72, and individual drive electrodes 76 formed in each piezoelectric element Pzt on a surface of the piezoelectric body 74. In the configuration, a region in which the piezoelectric body 74 is interposed between the drive electrode 72 and the drive electrode 76 which face each other, functions as the piezoelectric element Pzt.

The piezoelectric body 74 is formed in a process which includes, for example, a heating process (baking). In detail, the piezoelectric body 74 is formed by baking a piezoelectric material which is applied to a surface of the vibration plate 46 on which multiple drive electrodes 72 are formed, using heating processing of a furnace, and then molding (milling by using, for example, plasma) the baked material for each piezoelectric element Pzt.

In the same manner, the piezoelectric element Pzt corresponding to the nozzle column Nb is also configured to include the drive electrode 72, the piezoelectric body 74, and the drive electrode 76.

In addition, in this example, in the piezoelectric body 74, the common drive electrode 72 is used as a lower layer and the individual drive electrodes 76 are used as an upper layer, but in contrast to this, a configuration in which the common drive electrode 72 is used as an upper layer and the individual drive electrodes 76 are used as a lower layer, may be provided.

A configuration may be provided in which the drive IC is directly mounted in the actuator substrate 40.

As will be described below, meanwhile a voltage Vout of a drive signal according to the amount of ink to be ejected is individually applied to the drive electrode 76 which is a terminal of the piezoelectric element Pzt, a retention signal of a voltage $V_{BS}$ is commonly applied to the drive electrode 72 which is the other terminal of the piezoelectric element Pzt.

For this reason, the piezoelectric element Pzt becomes displaced upwardly or downwardly in accordance with a voltage which is applied to the drive electrodes 72 and 76. In detail, if the voltage Vout of the drive signal which is applied through the drive electrode 76 decreases, the central portion of the piezoelectric element Pzt is bent upwardly with respect to both end portions, and meanwhile, if the voltage Vout increases, the central portion of the piezoelectric element Pzt is bent downwardly.

If the central portion is bent upwardly, an internal volume of the cavity 442 increases (pressure decreases), and thus ink is drawn from the liquid reservoir chamber Sr. Meanwhile, if the central portion is bent downwardly, an internal volume of the cavity 442 decreases (pressure increases), and thus, an ink droplet is ejected from the nozzle N in accordance with the decreased degree. In this way, if a proper drive signal is applied to the piezoelectric element Pzt, ink is ejected from the nozzle N in accordance with the displacement of the piezoelectric element Pzt. For this reason, an ejecting unit which ejects ink in accordance with at least the piezoelectric element Pzt, the cavity 442, or the nozzle N, is configured.

Next, an electrical configuration of the printing apparatus 1 will be described.

Figure 4:
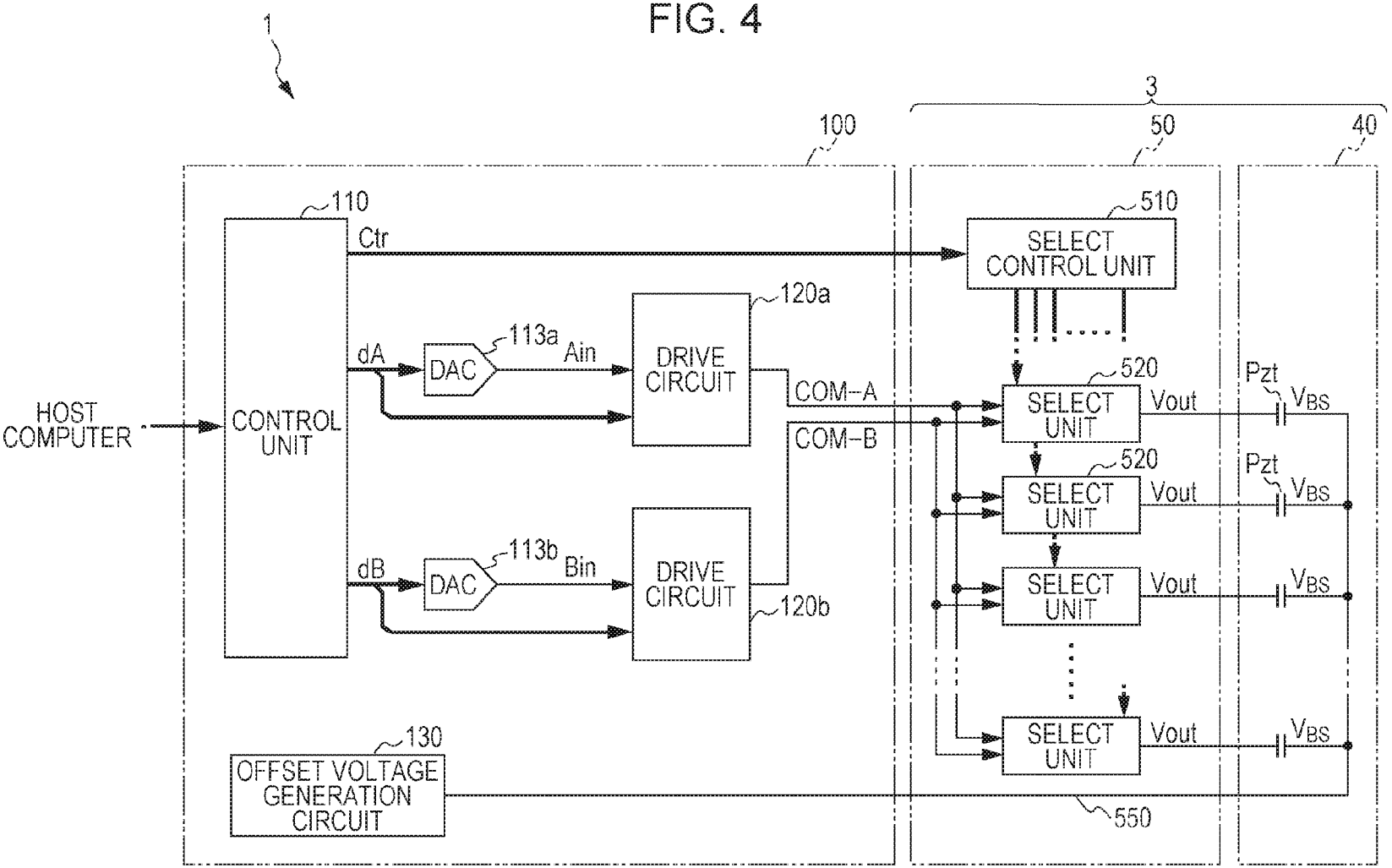
FIG. 4 is a diagram illustrating an electrical configuration of the printing apparatus.

FIG. 4 is a block diagram illustrating an electrical configuration of the printing apparatus 1.

As illustrated in FIG. 4, the printing apparatus 1 has a configuration in which the head unit 3 is coupled to a main substrate 100. The head unit 3 is largely divided into the actuator substrate 40 and a drive IC 50.

The main substrate 100 supplies a control signal Ctr or drive signals COM-A and COM-B to the drive IC 50, and supplies a retention signal of the voltage $V_{BS}$ (offset voltage) to the actuator substrate 40 through a wire 550.

In the printing apparatus 1, four head units 3 are provided, and the main substrate 100 independently controls the four head units 3. The four head units 3 are the same as each other except that the colors of ink to be ejected are different from each other, and thus, hereinafter, one head unit 3 will be representatively described for the sake of convenience.

As illustrated in FIG. 4, the main substrate 100 includes a control unit 110, D/A converters (DAC) 113*a* and 113*b*, drive circuits 120*a* and 120*b*, and an offset voltage generation circuit 130.

Among these, the control unit 110 is a type of a microcontroller having a CPU, a RAM, a ROM, and the like, and outputs various control signals or the like for controlling each unit by executing a predetermined program, when image data which becomes a printing target is supplied from a host computer or the like.

In detail, first, the control unit 110 repeatedly supplies digital data dA to the DAC 113*a* and the drive circuit 120*a*, and repeatedly supplies digital data dB to the DAC 113*b* and the drive circuit 120*b*, in the same manner. Here, the data dA defines a waveform of the drive signal COM-A which is supplied to the head unit 3, and the data dB defines a waveform of the drive signal COM-B.

The drive signals COM-A and COM-B (and signals Ain and Bin before being amplified) have respectively trapezoidal waveforms as will be described below.

The DAC 113*a* converts the digital data dA into analog data, and supplies to the drive circuit 120*a* as a signal Ain. In the same manner, the DAC 113*b* converts the digital data dB into analog data, and supplies to the drive circuit 120*b* as a signal Bin.

The drive circuit 120*a* will be described below in detail. The drive circuit 120*a* outputs the signal Ain to the piezoelectric element Pzt which is a capacitive load as the drive signal COM-A by voltage-amplifying and increasing drive capability (converting to low impedance). In the same manner, the drive circuit 120*b* outputs the signal Bin as the drive signal COM-B by voltage-amplifying and increasing drive capability.

The signal Ain (Bin) which is converted by the DAC 113*a* (113*b*) performs a small swing in a range of a voltage of, for example, approximately 0 V to 4 V, and in contrast to this, the drive signal COM-A (COM-B) performs a large swing in a range of a voltage of, for example, approximately 0 V to 40 V. For this reason, the drive circuit 120*a* (120*b*) is configured to amplify the voltage of the signal Ain (Bin) which is converted by the DAC 113*a* (113*b*) by, for example, 10 times and to output the amplified signal.

The drive circuits 120*a* and 120*b* just have different waveforms of signals which are input, and drive signals which are output, from each other, and have the same circuit configuration as each other.

Second, the control unit 110 supplies various control signals Ctr to the head unit 3, in synchronization with control for the moving mechanism 6 and the transport mechanism 8. The control signals Ctr which are supplied to the head unit 3 include print data (ejecting control signal) which defines the amount of ink which is ejected from the nozzle N, a clock signal which is used for transmission of the print data, a timing signal which defines a print period or the like, or the like.

The control unit 110 controls the moving mechanism 6 and the transport mechanism 8, but since a configuration thereof is known, and thus description thereof will be omitted.

The offset voltage generation circuit 130 in the main substrate 100 generates a retention signal of the voltage $V_{BS}$ and output the retention signal to the wire 550. The voltage $V_{BS}$ maintains the other terminals of the multiple piezoelectric elements Pzt in the actuator substrate 40 in a constant state.

Meanwhile, in the head unit 3, the drive IC 50 includes a select control unit 510 and select units 520 which correspond to the piezoelectric elements Pzt one to one. The select control unit 510 controls selection of each of the select units 520. In detail, the select control unit 510 stores the print data which is supplied in correspondence with a clock signal from the control unit 110 in several nozzles (piezoelectric elements Pzt) of the head unit 3 once, and instructs each select unit 520 to select the drive signals COM-A and COM-B in accordance with the print data at a start timing of a print period which is defined by a timing signal.

Each select unit 520 selects (or does not select any one) one of the drive signals COM-A and COM-B in accordance with instruction of the select control unit 510, and applies the selected signal to one terminal of the corresponding piezoelectric element Pzt as a drive signal of the voltage Vout.

As described above, one piezoelectric element Pzt is provided in each nozzle N in the actuator substrate 40. The other terminals of each piezoelectric element Pzt are coupled in common, and the voltage $V_{BS}$ from the offset voltage generation circuit 130 is applied to the other terminals through the wire 550.

In the present embodiment, ink is ejected from one nozzle N maximum twice by one dot, and thus four gradations of a large dot, a medium dot, a small dot, and no record are represented. In the present embodiment, in order to represent the four gradations, two types of the drive signals COM-A and COM-B are prepared, and each period has first half pattern and a second half pattern. Then, during one period, the drive signals COM-A and COM-B are selected (or not selected) in accordance with a gradation to be represented in the first half and a second half, and the selected signal is supplied to the piezoelectric element Pzt.

Thus, the drive signals COM-A and COM-B will be first described, and thereafter, a detailed configuration of the select control unit 510 for selecting the drive signals COM-A and COM-B, and the select unit 520 will be described.

Figure 5:
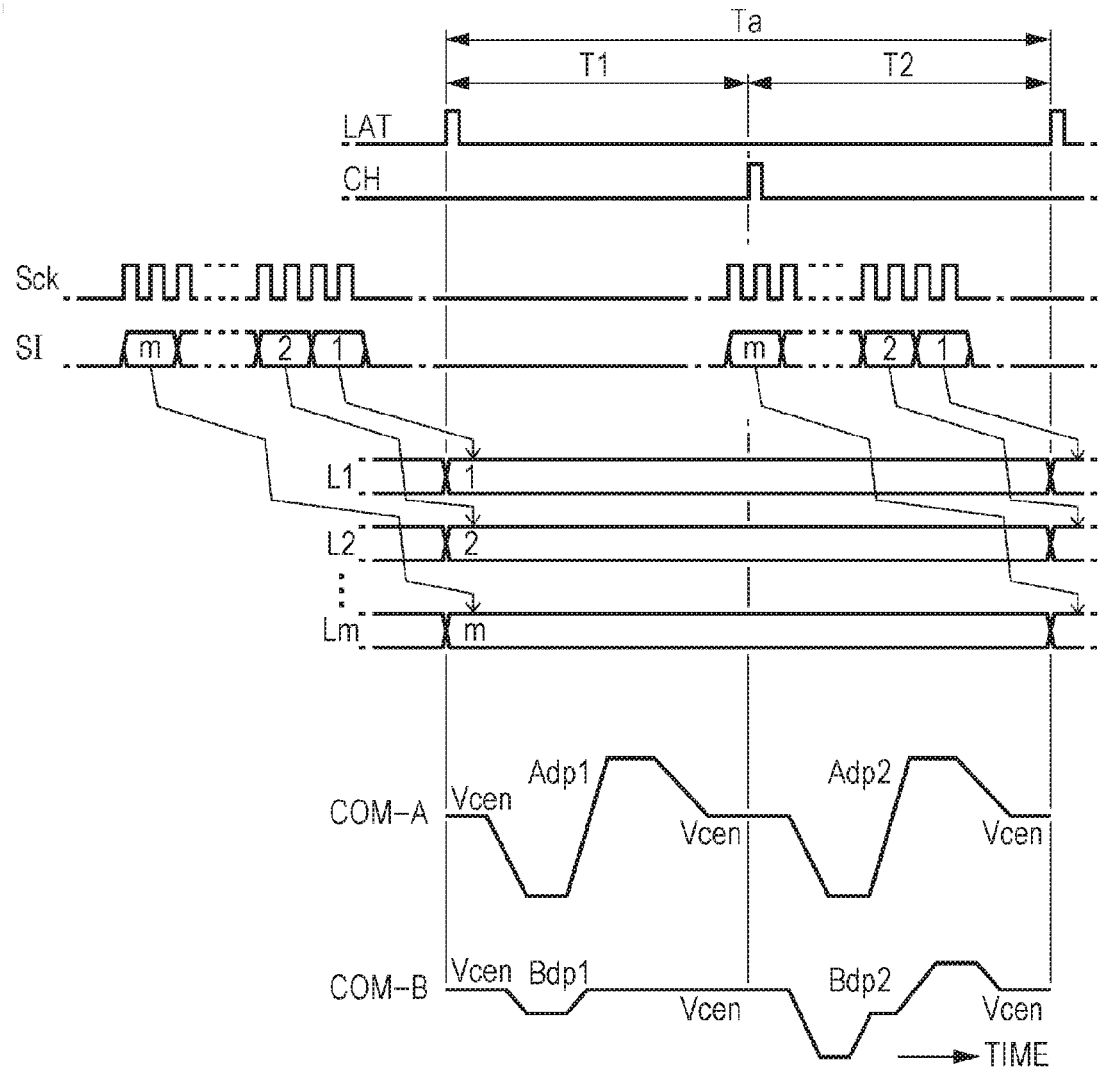
FIG. 5 is a diagram illustrating waveforms or the like of drive signals.

FIG. 5 is a diagram illustrating waveforms or the like of drive signals COM-A and COM-B.

As illustrated in FIG. 5, the drive signal COM-A is configured by a repeated waveform of a trapezoidal waveform Adp1 which is disposed during a period T1 from time when a control signal LAT is output (rises) to time when a control signal CH is output, during a print period Ta, and a trapezoidal waveform Adp2 which is disposed during a period T2 from time when the control signal CH is output and to the control signal LAT is output.

In the present embodiment, the trapezoidal waveforms Adp1 and Adp2 are approximately the same waveforms as each other, and are waveforms which respectively eject a predetermined amount of ink, in detail, an approximately medium amount of ink from the nozzles N corresponding to the piezoelectric elements Pzt, if each of the trapezoidal waveforms Adp1 and Adp2 is supplied to the one terminal of the piezoelectric element Pzt.

The drive signal COM-B is configured by a repeated waveform of a trapezoidal waveform Bdp1 which is disposed during the period T1 and a trapezoidal waveform Bdp2 which is disposed during the period T2. In the present embodiment, the trapezoidal waveforms Bdp1 and Bdp2 are waveforms different form each other. Among these, the trapezoidal waveform Bdp1 is a waveform for preventing an increase of viscosity of ink by slightly vibrating the ink near the nozzle N. For this reason, even if the trapezoidal waveform Bdp1 is supplied to the one terminal of the piezoelectric element Pzt, ink is not ejected from the nozzle N corresponding to the piezoelectric element Pzt. In addition, the trapezoidal waveform Bdp2 is a waveform different from the trapezoidal waveform Adp1 (Adp2). If the trapezoidal waveform Bdp2 is supplied to the one terminal of the piezoelectric element Pzt, the trapezoidal waveform Bdp2 becomes a waveform which ejects the amount of ink less than the predetermined amount from the nozzle N corresponding to the piezoelectric element Pzt.

Voltages at a start timing of the trapezoidal waveforms Adp1, Adp2, Bdp1, and Bdp2, and voltages at an end timing of the trapezoidal waveforms Adp1, Adp2, Bdp1, and Bdp2 are all common at a voltage Vcen. That is, the trapezoidal waveforms Adp1, Adp2, Bdp1, and Bdp2 are waveforms which respectively start at the voltage Vcen and ends at the voltage Vcen.

Since the drive circuit 120*a* (120*b*) outputs a voltage of the signal Ain (Bin) by amplifying 10 times as described above, the Ain (Bin) which is input includes an error which will be described below, and has a waveform in which a voltage of the drive signal COM-A (COM-B) is used as 1/10 as it is.

Figures 6, 7:
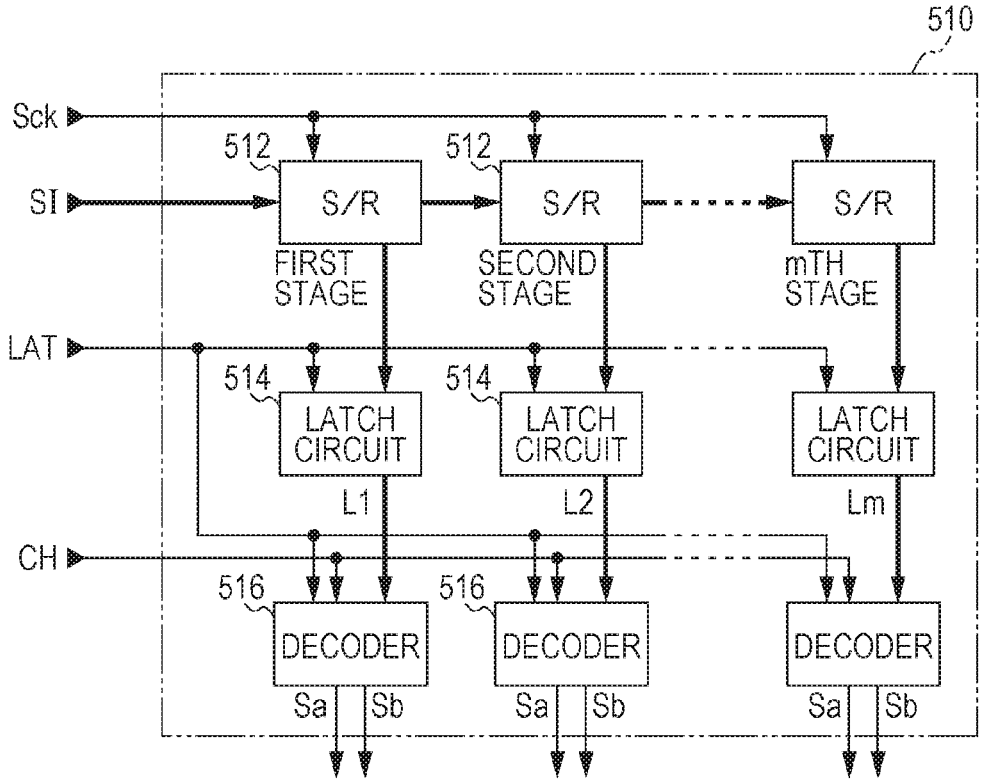
FIG. 6 is a diagram illustrating a configuration of a select control unit.
FIG. 7 is a diagram illustrating decoded content of a decoder.

FIG. 6 is a diagram illustrating a configuration of the select control unit 510 of FIG. 4.

As illustrated in FIG. 6, a clock signal Sck, the print data SI, and the control signals LAT and CH are supplied to the select control unit 510. Multiple sets of a shift register (S/R) 512, a latch circuit 514, and a decoder 516 are provided in correspondence with each of the piezoelectric elements Pzt (nozzles N) in the select control unit 510.

The print data SI is data which defines dots to be formed by all the nozzles N in the head unit 3 which is focused during the print period Ta. In the present embodiment, in order to represent the four gradations of no record, a small dot, a medium dot, and a large dot, the print data for one nozzle is configured by two bits of a most significant bit (MSB) and a least significant bit (LSB).

The print data SI is supplied in accordance with transport of the medium P for each nozzle N (piezoelectric element Pzt) in synchronization with the clock signal Sck. The shift register 512 has a configuration in which the print data SI of two bits is retained once in correspondence with the nozzle N.

In detail, shift registers 512 of total m stages corresponding to each of m piezoelectric elements Pzt (nozzles) are coupled in cascade, and the print data SI which is supplied to the shift register 512 of a first stage located at a left end of FIG. 6 is sequentially transmitted to the rear stage (downward side) in accordance with the clock signal Sck.

In FIG. 6, in order to separate the shift registers 512, the shift register 512 are sequentially referred to as a first stage, a second stage, . . . , an mth stage from an upper side to which the print data SI is supplied.

The latch circuit 514 latches the print data SI retained in the shift register 512 at a rising edge of the control signal LAT.

The decoder 516 decodes the print data SI of two bits which are latched in the latch circuit 514, outputs select signals Sa and Sb for each of periods T1 and T2 which are defined by the control signal LAT and the control signal CH, and defines select of the select unit 520.

FIG. 7 is a diagram illustrating decoded content of the decoder 516.

In FIG. 7, the print data SI of two bits which are latched is referred to as an MSB and an LSB. In the decoder 516, if the latched print data SI is (0,1), it means that logic levels of the select signals Sa and Sb are respectively output as levels of H and L during the period T1, and levels of L and H during the period T2.

The logic levels of the select signals Sa and Sb are level-shifted by a level shifter (not illustrated) to a higher amplitude logic than the logic levels of the clock signal Sck, the print data SI, and the control signals LAT and CH.

Figure 8:
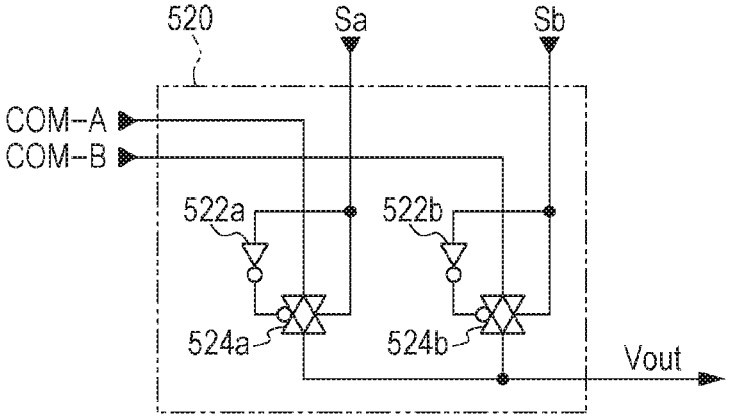
FIG. 8 is a diagram illustrating a configuration of a select unit.

FIG. 8 is a diagram illustrating a configuration of the select unit 520 of FIG. 4.

As illustrated in FIG. 8, the select unit 520 includes inverters (NOT circuit) 522*a* and 522*b*, and transfer gates 524*a* and 524*b*.

The select signal Sa from the decoder 516 is supplied to a positive control terminal to which a round mark is not attached in the transfer gate 524*a*, is logically inverted by the inverter 522*a*, and is supplied to a negative control terminal to which a round mark is attached in the transfer gate 524*a*. In the same manner, the select signal Sb is supplied to a positive control terminal of the transfer gate 524*b*, is logically inverted by the inverter 522*b*, and is supplied to a negative control terminal of the transfer gate 524*b*.

The drive signal COM-A is supplied to an input terminal of the transfer gate 524*a*, and the drive signal COM-B is supplied to an input terminal of the transfer gate 524*b*. The output terminals of the transfer gates 524*a* and 524*b* are coupled to each other, and are coupled to one terminal of the corresponding piezoelectric element Pzt.

If the select signal Sa goes to an H level, the input terminal and the output terminal of the transfer gate 524*a* are electrically coupled (ON) to each other. If the select signal Sa goes to an L level, the input terminal and the output terminal of the transfer gate 524*a* are electrically decoupled (OFF) from each other. In the same manner, the input terminal and the output terminal of the transfer gate 524*b* are also electrically coupled to each other or decoupled from each other in accordance with the select signal Sb.

As illustrated in FIG. 5, the print data SI is supplied to each nozzle in synchronization with the clock signal Sck, and is sequentially transmitted to the shift registers 512 corresponding to the nozzles. Thus, if supply of the clock signal Sck is stopped, the print data SI corresponding to each nozzle is retained in each of the shift registers 512.

If the control signal LAT rises, each of the latch circuits 514 latches all of the print data SI retained in the shift registers 512. In FIG. 5, the number in L1, L2, . . . , Lm indicate the print data SI which is latched by the latch circuits 514 corresponding to the shift registers 512 of the first stage, the second stage, . . . , the mth stage.

The decoder 516 outputs the logic levels of the select signals Sa and Sb in the content illustrated in FIG. 7 in accordance with the size of the dots which are defined by the latched print data SI during the periods T1 and T2.

That is, first, the decoder 516 sets the select signals Sa and Sb to levels of H and L during the period T1 and levels of H and L even during the period T2, if the print data SI is (1,1) and the size of the large dot is defined. Second, the decoder 516 sets the select signals Sa and Sb to levels of H and L during the period T1 and levels of L and H during the period T2, if the print data SI is (0,1) and the size of the medium dot is defined. Third, the decoder 516 sets the select signals Sa and Sb to levels of L and L during the period T1 and levels of L and H during the period T2, if the print data SI is (1,0) and the size of the small dot is defined. Fourth, the decoder 516 sets the select signals Sa and Sb to levels of L and H during the period T1 and levels of L and L during the period T2, if the print data SI is (0,0) and no recode is defined.

Figure 9:
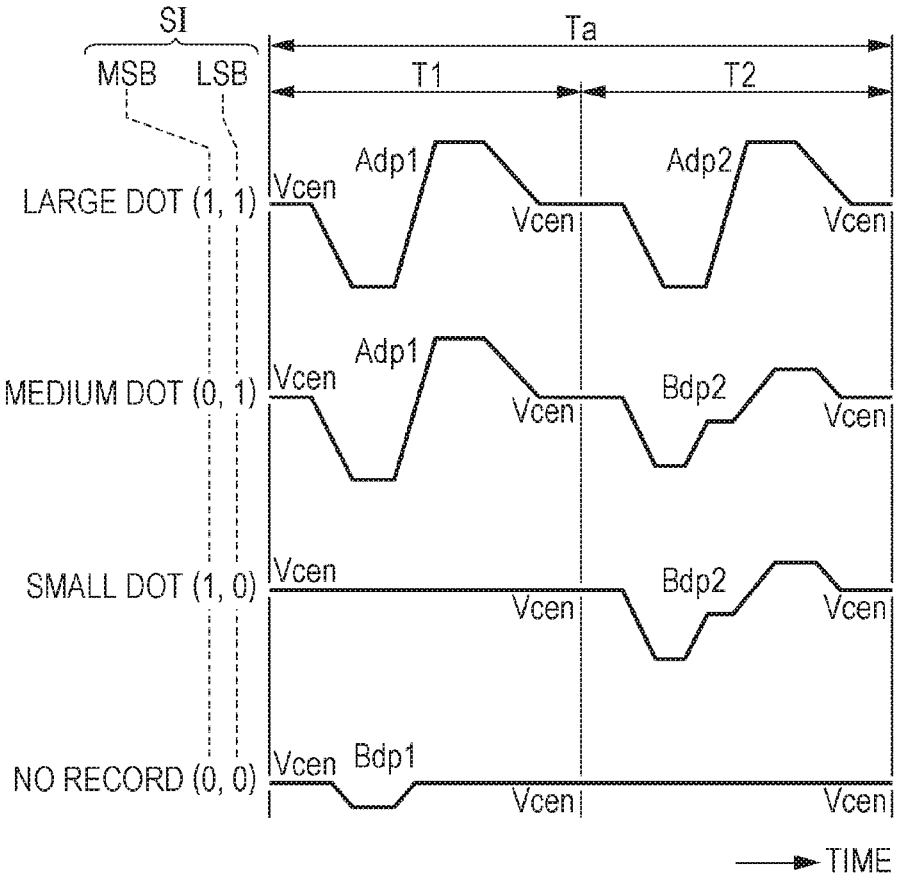
FIG. 9 is a diagram illustrating drive signals which are selected by the select unit and are supplied to a piezoelectric element.

FIG. 9 is a diagram illustrating waveforms of the drive signals which are selected in accordance with the print data SI and are supplied to one terminal of the piezoelectric element Pzt.

When the print data SI is (1,1), the select signals Sa and Sb become H and L levels during the period T1, and thus the transfer gate 524*a* is turned on, and the transfer gate 524*b* is turned off. For this reason, the trapezoidal waveform Adp1 of the drive signal COM-A is selected during the period T1. Since the select signals Sa and Sb go to H and L levels even during the period T2, the select unit 520 selects the trapezoidal waveform Adp2 of the drive signal COM-A.

In this way, if the trapezoidal waveform Adp1 is selected during the period T1, the trapezoidal waveform Adp2 is selected during the period T2, and the selected waveforms are supplied to one terminal of the piezoelectric element Pzt as drive signals, ink of an approximately medium amount is ejected twice from the nozzle N corresponding to the piezoelectric element Pzt. For this reason, each ink is landed on and combined with the medium P, and as a result, a large dot is formed as defined by the print data SI.

When the print data SI is (0,1), the select signals Sa and Sb become H and L levels during the period T1, and thus the transfer gate 524*a* is turned on, and the transfer gate 524*b* is turned off. For this reason, the trapezoidal waveform Adp1 of the drive signal COM-A is selected during the period T1. Next, since the select signals Sa and Sb go to L and H levels during the period T2, the trapezoidal waveform Bdp2 of the drive signal COM-B is selected.

Hence, ink of an approximately medium amount and an approximately small amount is ejected twice from the nozzle N. For this reason, each ink is landed on and combined with the medium P, and as a result, a medium dot is formed as defined by the print data SI.

When the print data SI is (1,0), the select signals Sa and Sb become all L levels during the period T1, and thus the transfer gates 524*a* and 524*b* are turned off. For this reason, the trapezoidal waveforms Adp1 and Bdp1 are not selected during the period T1. If the transfer gates 524*a* and 524*b* are all turned off, a path from a coupling point of the output terminals of the transfer gates 524*a* and 524*b* to one terminal of the piezoelectric element Pzt becomes a high impedance state in which the path is not electrically coupled to any portion. However, both terminals of the piezoelectric element Pzt retain a voltage (Vcen−$V_{BS}$) shortly before the transfer gates are turned off, by capacitance included in the piezoelectric element Pzt itself.

Next, since the select signals Sa and Sb go to L and H levels during the period T2, the trapezoidal waveform Bdp2 of the drive signal COM-B is selected. For this reason, ink of an approximately small amount is ejected from the nozzle N only during the period T2, and thus small dot is formed on the medium P as defined by the print data SI.

When the print data SI is (0,0), the select signals Sa and Sb become L and H levels during the period T1, and thus the transfer gates 524*a* is turned off and the transfer gate 524*b* is turned on. For this reason, the trapezoidal waveforms Bdp1 of the drive signal COM-B is selected during the period T1. Next, since all of the select signals Sa and Sb go to L levels during the period T2, the trapezoidal waveforms Adp2 and Bdp2 are all not selected.

For this reason, ink near the nozzle N just slightly vibrates during the period T1, and the ink is not ejected, and thus, as a result, dots are not formed, that is, no record is made as defined by the print data SI.

In this way, the select unit 520 selects (or does not select) the drive signals COM-A and COM-B in accordance with instruction of the select control unit 510, and applies the selected signal to one terminal of the piezoelectric element Pzt. For this reason, each of the piezoelectric elements Pzt is driven in accordance with the size of the dot which is defined by the print data SI.

The drive signals COM-A and COM-B illustrated in FIG. 5 are just an example. Actually, combinations of various waveforms which are prepared in advance are used in accordance with properties, transport speed, or the like of the medium P.

In addition, here, an example in which the piezoelectric element Pzt is bent upwardly in accordance with a decreases of a voltage is used, but if a voltage which is applied to the drive electrodes 72 and 76 is inverted, the piezoelectric element Pzt is bent downwardly in accordance with a decrease of the voltage. For this reason, in a configuration in which the piezoelectric element Pzt is bent downwardly in accordance with a decrease of a voltage, the drive signals COM-A and COM-B illustrated in the figure have waveforms which are inverted by using the voltage Vcen as a reference.

Next, with regard to the drive circuits 120*a* and 120*b* in the main substrate 100, an example in which the drive circuit 120*a* that outputs the drive signal COM-A is used will be used, but parts of parentheses represent a case in which the drive circuit 120*b* is used.

Figure 10:
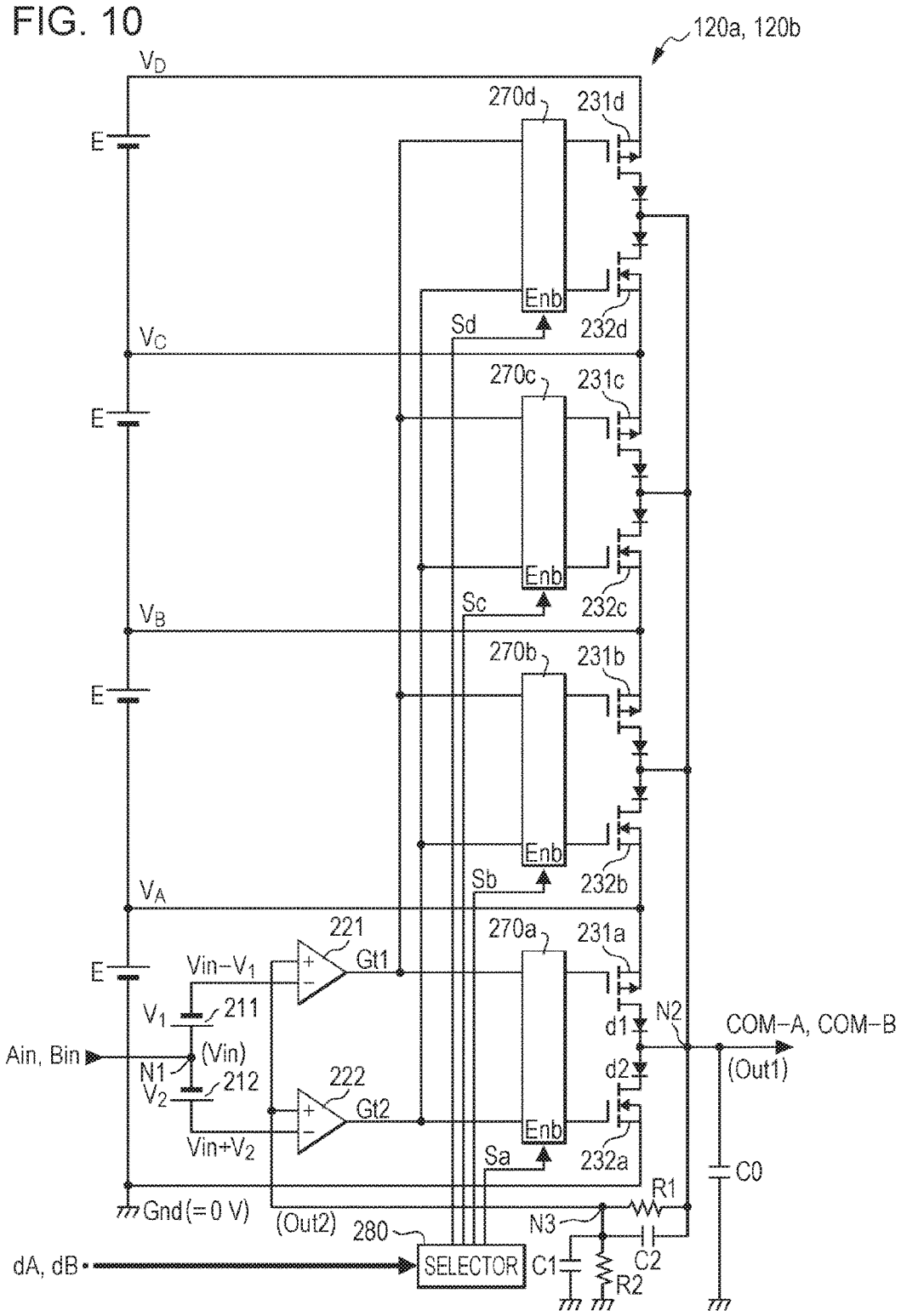
FIG. 10 is a diagram illustrating a configuration of a drive circuit.

FIG. 10 is a diagram illustrating a configuration of the drive circuit 120*a*.

As illustrated in FIG. 10, the drive circuit 120*a* includes four reference power supplies E, reference power supplies 211 and 212, comparators 221 and 222, level shifters 270*a*, 270*b*, 270*c*, and 270*d*, a selector 280, four pairs of transistors, resistor elements R1 and R2, capacitors C0, C1, and C2.

The reference power supply (first offset unit) 211 outputs a voltage $V_1$ between a positive terminal and a negative terminal thereof. Here, the positive terminal of the reference power supply 211 is coupled to a terminal N1 to which a voltage Vin of the signal Ain is supplied from a DAC 113*a* (refer to FIG. 4), and the negative terminal of the reference power supply 211 is coupled to a negative input terminal (−) of the comparator 221. For this reason, a voltage (Vin−$V_1$) which is obtained by subtracting the voltage $V_1$ from the voltage Vin that is an input signal is applied to the negative input terminal (−) of the comparator 221. The positive input terminal (+) of the comparator 221 is coupled to a terminal N3 (input node).

The terminal N3 is coupled to a terminal N2 (output node) from which the voltage Out1 is output through the resistor element R1 (first resistor), and is coupled to the ground Gnd of zero volts through the resistor element R2 (second resistor). A voltage Out2 of the terminal N3 is a voltage which drops (is divided) a voltage of the voltage Out1 in a ratio between resistance values of the resistor elements R1 and R2. In the present embodiment, the drop ratio is set to 1/10 of an inverse number of a voltage amplification factor of the drive circuit 120*a*. In other words, the voltage Out2 has a relationship of 1/10 of the voltage Out1.

The capacitor C0 (output capacitor) is provided to prevent abnormal oscillation from occurring, one terminal thereof is coupled to the terminal N2, and the other terminal thereof is coupled to, for example, a ground Gnd having a constant potential.

In addition, one terminal of the capacitor C1 (first capacitor) is coupled to the terminal N3, and the other terminal the capacitor C1 is coupled to the ground Gnd. Therefore, when viewed from the terminal N2 and the terminal N3, an integral circuit is configured by the resistor element R1 and the capacitor C1. One terminal of the capacitor C2 (second capacitor) is coupled to the terminal N2, and the other terminal of the capacitor C2 is coupled to the terminal N2. Therefore, when viewed from the terminal N2 and the terminal N3, a differentiation circuit is configured by the resistor element R2 and the capacitor C2.

In the present example, a differentiation and integration circuit is configured by combining the differentiation circuit with the integration circuit, and thereby a signal which is obtained by synthesizing a signal passing through the integration circuit with a signal passing through the differentiation circuit among the signals of the terminals N is supplied to the terminal N3.

The comparator (first comparator) 221 outputs a signal Gt1 which is obtained by comparing a voltage applied to the positive input terminal (+) with a voltage applied to the negative input terminal (−), as a first control signal. In detail, the comparator 221 outputs the signal Gt1 with an H level, if the voltage Out2 applied to the positive input terminal (+) is higher than or equal to the voltage (Vin−$V_1$) applied to the negative input terminal (−), and outputs the signal Gt1 with an L level, if the voltage Out2 is lower than the voltage (Vin−$V_1$).

Here, in the comparator 221, if a signal of the voltage (Vin−$V_1$) applied to the negative input terminal (−) is set as a first comparison signal, a signal of the voltage Out2 applied to the positive input terminal (+) is set as a second comparison signal in which a signal based on the drive signal is offset to zero volts.

Meanwhile, the reference power supply (second offset unit) 212 outputs a voltage $V_2$ between a positive terminal and a negative terminal thereof. Here, the negative terminal of the reference power supply 212 is coupled to the terminal N1, and the positive terminal of the reference power supply 212 is coupled to a negative input terminal (−) of the comparator 222. For this reason, a voltage (Vin+$V_2$) which is obtained by adding the voltage $V_2$ to the voltage Vin that is an input signal is applied to the negative input terminal (−) of the comparator 221. The positive input terminal (+) of the comparator 221 (second comparator) is coupled to the terminal N3.

The comparator 222 outputs a signal Gt2 which is obtained by comparing a voltage applied to the positive input terminal (+) with a voltage applied to the negative input terminal (−), as a second control signal. In detail, the comparator 222 outputs the signal Gt2 with an H level, if the voltage Out2 applied to the positive input terminal (+) is higher than or equal to the voltage (Vin+$V_2$) applied to the negative input terminal (−), and outputs the signal Gt2 with an L level, if the voltage Out2 is lower than the voltage (Vin+$V_2$).

Here, in the comparator 222, if a signal of the voltage (Vin+$V_2$) applied to the negative input terminal (−) is set as a third comparison signal, a signal of the voltage Out2 applied to the positive input terminal (+) is set as a fourth comparison signal in which a signal based on the drive signal is offset to zero volts.

With regard to logic levels of the signal Gt1 which is output from the comparator 221 and the signal Gt2 which is output from the comparator 222, for example, an H level indicates 4 V which is a maximum voltage of the signal Ain (Bin) and the terminal N3, and an L level indicates the ground Gnd of zero volts. Power of the comparators 221 and 222 has a relatively small swing of approximately 4 V, while not being illustrated.

In the example illustrated in FIG. 10, voltages E, 2E, 3E, and 4E are respectively output as voltages $V_A$, $V_B$, $V_C$, and $V_D$ by four-stage series coupling of a reference power supply which outputs the voltage E.

Figure 11:
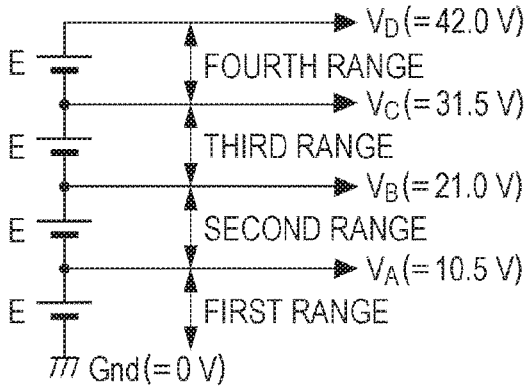
FIG. 11 is a diagram illustrating a power supply voltage which is applied to the drive circuit.

FIG. 11 is a diagram illustrating the voltages $V_A$, $V_B$, $V_C$, and $V_D$.

As illustrated in FIG. 11, when the voltage E is set to, for example, 10.5 V, the voltages $V_A$, $V_B$, $V_C$, and $V_D$ are respectively set to 10.5 V, 21.0 V, 31.5 V, and 42.0 V. In the present embodiment, the following voltage ranges are defined in accordance with the voltages $V_A$, $V_B$, $V_C$, and $V_D$. That is, voltages higher than or equal to zero volts and lower than the voltage $V_A$ are defined as a first range, voltages higher than or equal to the voltage $V_A$ and lower than the voltage $V_B$ are defined as a second range, voltages higher than or equal to the voltage $V_B$ and lower than the voltage $V_C$ are defined as a third range, and voltages higher than or equal to the voltage $V_C$ and lower than the voltage $V_D$ are defined as a fourth range.

The selector 280 discriminates a voltage range of the voltage Vin of the signal Ain (Bin) from the data dA (dB) which is supplied from the control unit 110 (refer to FIG. 4), and outputs select signals Sa, Sb, Sc, and Sd in accordance with the discrimination result as follows.

In detail, if the voltage Vin which is defined by the data dA (dB) is discriminated as voltages higher than or equal to 0 V and lower than 1.05 V, that is, if a voltage at the time of amplifying the voltage Vin 10 times is included in the first range, the selector 280 sets only the select signal Sa to an H level, and sets the other select signals Sb, Sc, and Sd to an L level. In addition, if the voltage Vin which is defined by the data dA (dB) is discriminated as voltages higher than or equal to 1.05 V and lower than 2.10 V, that is, if a voltage at the time of amplifying the voltage Vin 10 times is included in the second range, the selector 280 sets only the select signal Sb to an H level, and sets the other select signals Sa, Sc, and Sd to an L level. In the same manner, if the voltage Vin which is defined by the data dA (dB) is discriminated as voltages higher than or equal to 2.10 V and lower than 3.15 V, that is, if a voltage at the time of amplifying the voltage Vin 10 times is included in the third range, the selector 280 sets only the select signal Sc to an H level, and sets the other select signals Sa, Sb, and Sd to an L level. If the voltage Vin is discriminated as voltages higher than or equal to 3.15 V and lower than 4.20 V, that is, if a voltage at the time of amplifying the voltage Vin 10 times is included in the fourth range, the selector 280 sets only the select signal Sd to an H level, and sets the other select signals Sa, Sb, and Sc to an L level.

When enabled, the level shifter 270*a* shifts logic levels of the signal Gt1 and Gt2, and supplies the shifted signals to gates of transistors 231*a* and 232*a*. In detail, when the select signal Sa goes to an H level, the level shifter 270*a* is enabled, shifts an H level of the signal Gt1 to, for example, the voltage $V_A$ (=10.5 V), shifts an L level to, for example, the ground Gnd (zero volts), and supplies the shifted signal to a gate electrode of the transistor 231*a*. In addition, the level shifter 270*a* shifts an H level of the signal Gt2 to the voltage $V_A$, shifts an L level to the ground Gnd, and supplies the shifted signal to a gate electrode of the transistor 232*a*.

When the select signal Sb goes to an H level, the level shifter 270*b* is enabled, shifts an H level of the signal Gt1 to, for example, the voltage $V_B$ (=21.0 V), shifts an L level to, for example, the voltage $V_A$ (=10.5 V), and supplies the shifted signal to a gate electrode of the transistor 231*b*. In addition, the level shifter 270*b* shifts an H level of the signal Gt2 to the voltage $V_B$, shifts an L level to the voltage $V_A$, and supplies the shifted signal to a gate electrode of the transistor 232*b*.

In the same manner, when the select signal Sc goes to an H level, the level shifter 270*c* is enabled, shifts an H level of the signal Gt1 to, for example, the voltage $V_C$ (=31.5 V), shifts an L level to, for example, the voltage $V_B$ (=21.0 V), and supplies the shifted signal to a gate electrode of the transistor 231*c*. In addition, the level shifter 270*c* shifts an H level of the signal Gt2 to the voltage $V_C$, shifts an L level to the voltage $V_B$, and supplies the shifted signal to a gate electrode of the transistor 232*c*.

Then, when the select signal Sd goes to an H level, the level shifter 270*d* is enabled, shifts an H level of the signal Gt1 to, for example, the voltage $V_D$ (=42.0 V), shifts an L level to, for example, the voltage $V_C$ (=31.5 V), and supplies the shifted signal to a gate electrode of the transistor 231*d*. In addition, the level shifter 270*d* shifts an H level of the signal Gt2 to the voltage $V_D$, shifts an L level to the voltage $V_C$, and supplies the shifted signal to a gate electrode of the transistor 232*d*.

If disabled, that is, if corresponding select signals go to an L level, the level shifters 270*a*, 270*b*, 270*c*, and 270*d* respectively output signals which respectively turn off corresponding two transistors. If disabled, that is, if channels of corresponding two transistors are the types which will be described next, the level shifters 270*a*, 270*b*, 270*c*, and 270*d* forcibly change the signal Gt1 into a signal with an H level, and forcibly change the signal Gt2 into a signal with an L level.

The transistor 231*a* is, for example, a p-channel field effect transistor, the voltage $V_A$ is applied to a source terminal thereof, and a drain terminal thereof is coupled to a terminal N2 through a diode d1. The transistor 232*a* is, for example, an n-channel field effect transistor, a source terminal thereof is coupled to the ground Gnd, and a drain terminal thereof is coupled to the terminal N2 through a diode d2. The diodes d1 and d2 are used for preventing a reverse current, a forward direction of the diode d1 is a direction toward the terminal N2 from the drain terminal of the transistor 231*a*, and a forward direction of the diode d2 is a direction toward the drain terminal of the transistor 232*a* from the terminal N2.

In the same manner, the transistor 231*b* (231*c*, 231*d*) is, for example, a p-channel field effect transistor, the voltage $V_B$ ($V_C$, $V_D$) is applied to a source terminal thereof, and a drain terminal thereof is coupled to a terminal N2 through a diode d1. The transistor 232*b* (232*c*, 232*d*) is, for example, an n-channel field effect transistor, the voltage $V_A$ ($V_B$, $V_C$) is applied to a source terminal thereof, and a drain terminal thereof is coupled to the terminal N2 through a diode d2.

For example, if the transistor 231*a* is referred to as a first transistor, the transistor 232*a* is referred to as a second transistor, and the transistors 231*a* and 232*a* are referred to as a first pair of transistors, the transistor 231*b* is referred to as a third transistor, the transistor 232*b* is referred to as a fourth transistor, and the transistors 231*b* and 232*b* are referred to as a fourth pair of transistors.

In addition, detailed description will be made below, but when the level shifter 270*a* is enabled, the transistors 231*a* and 232*a* output drive signals by using the voltage $V_A$ and the ground Gnd as power supply voltages, and when the level shifter 270*b* is enabled, the transistors 231*b* and 232*b* output drive signals by using the voltage $V_A$ and the voltage $V_B$ as power supply voltages. In the same manner, when the level shifter 270*c* is enabled, the transistors 231*c* and 232*c* output drive signals by using the voltage $V_C$ and the voltage $V_B$ as power supply voltages, and when the level shifter 270*d* is enabled, the transistors 231*d* and 232*d* output drive signals by using the voltage $V_D$ and the voltage $V_C$ as power supply voltages.

In this configuration, the power supply voltage of the transistors 231*a* and 232*a*, the power supply voltage of the transistors 231*b* and 232*b*, the power supply voltage of the transistors 231*c* and 232*c*, and the power supply voltage of the transistors 231*d* and 232*d* are all 10.5 V.

If the drive circuit 120*a* is electrically coupled to the terminal N2, the drive signal COM-A is output from the terminal N2, and if the drive circuit 120*b* is electrically coupled to the terminal N2, the drive signal COM-B is output from the terminal N2.

Next, operations of the drive circuits 120*a* and 120*b* will be described by using an example in which the drive circuit 120*a* which outputs the drive signal COM-A is used. In description of the operation, a configuration without the capacitors C1 and C2 will be first described, and thereafter, effects of a configuration with the capacitors C1 and C2 will be described.

Figure 12:
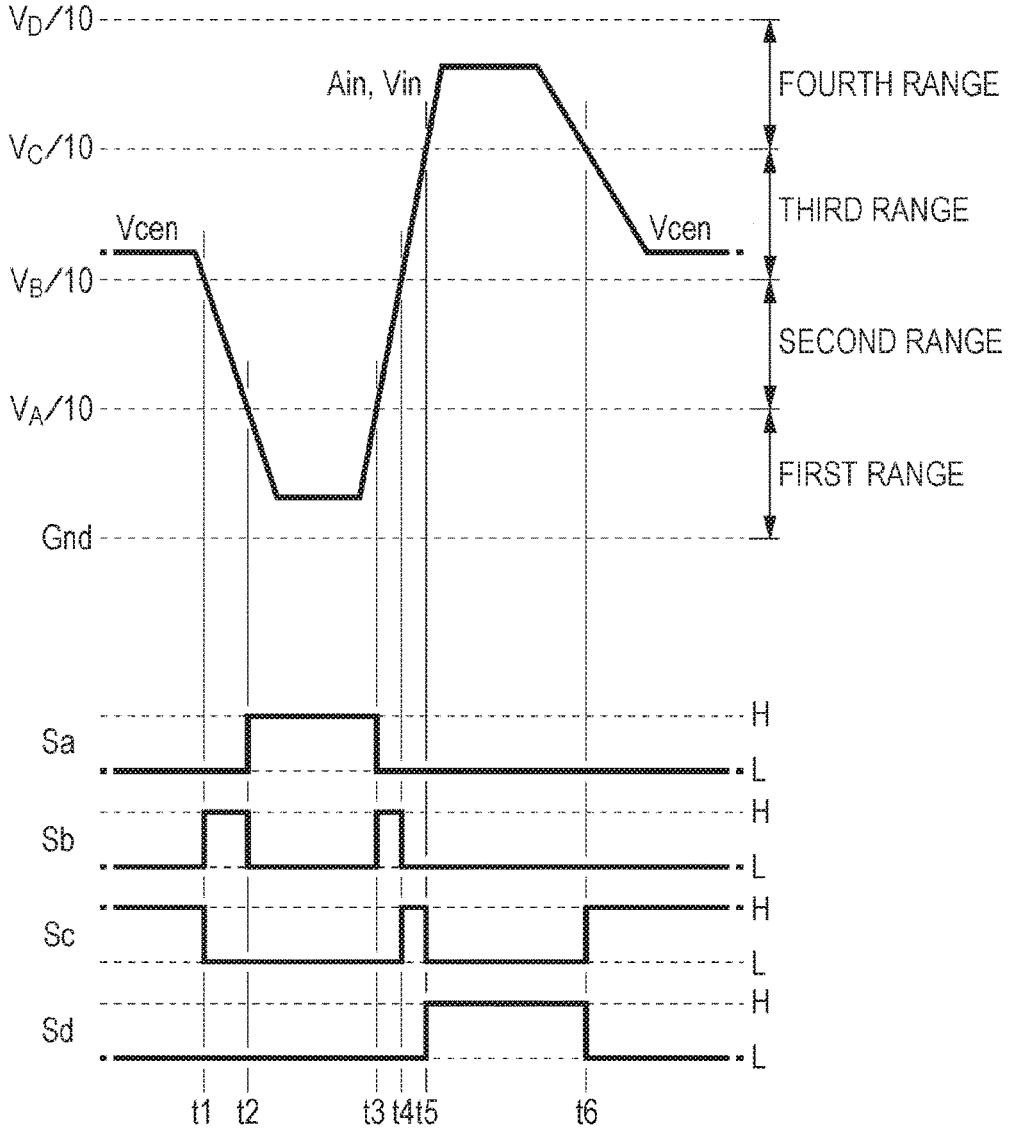
FIG. 12 is a diagram illustrating an operation of the drive circuit.

FIG. 12 is a diagram illustrating the operation of the drive circuit 120*a*.

As described above, during a print period Ta of the drive signal COM-A, two trapezoidal waveforms Adp1 and Adp2 which are the same as each other are repeated, and thus the signal Ain before voltage amplification of the drive signal COM-A has also the same waveform.

However, the signal Ain has a voltage of 1/10 of the voltage of the drive signal COM-A. For this reason, if the first range to the fourth range which are defined by the voltages $V_A$, $V_B$, $V_C$, and $V_D$ are changed to a voltage range of the signal Ain, the first range to the fourth range may be defined by voltages $V_A/10$, $V_B/10$, $V_C/10$, and $V_D/10$. That is, in the voltage Vin, voltages higher than or equal to 0 V and lower than $V_A/10$ (=1.05 V) correspond to the first range, voltages higher than or equal to $V_A/10$ and lower than $V_B/10$ (=2.10 V) correspond to the second range, voltages higher than or equal to $V_B/10$ and lower than $V_C/10$ (=3.15 V) correspond to the third range, and voltages higher than or equal to $V_C/10$ and lower than $V_D/10$ (=4.20 V) correspond to the fourth range.

FIG. 12 illustrates one trapezoidal waveform of the signal Ain, and in detail, illustrates a state in which, when viewed from the voltage Vin of the signal Ain, a voltage corresponding to, for example, the voltage Vcen is in the third range, decreases through the second range and the first range with passage of time, increases from the first range to the fourth range at once, and thereafter, decreases to a voltage corresponding to the voltage Vcen in the third range.

To begin with, if the voltage Vin is in third range and is discriminated from the data dA, the selector 280 sets only the select signal Sc to an H level, and sets the other select signals Sa, Sb, and Sd to an L level, and thereby the level shifter 270*c* is enabled, and the other level shifters 270*a*, 270*b*, and 270*d* are disabled. Hence, in this case, the transistors 231*c* and 232*c* output the drive signal COM-A, using the voltages $V_C$ and $V_B$ as power supply voltages.

Next, when the voltage Vin is in the second range during a period from timing t1 to timing t2, the selector 280 sets only the select signal Sb to an H level, and sets the other select signals Sa, Sc, and Sd to an L level, and thereby the level shifter 270*b* is enabled, and the other level shifters 270*a*, 270*c*, and 270*d* are disabled. Hence, in this case, the transistors 231*b* and 232*b* output the drive signal COM-A, using the voltages $V_B$ and $V_A$ as power supply voltages.

When the voltage Vin is in the first range during a period from timing t2 to timing t3, the selector 280 sets only the select signal Sa to an H level, and as a result, only the level shifter 270*a* is enabled, and thus the transistors 231*a* and 232*a* output the drive signal COM-A, using the voltages $V_A$ and the ground Gnd as power supply voltages.

The subsequent operations will be described in brief. Since only the level shifter 270*b* is enabled during a period from timing t3 to timing t4, the transistors 231*b* and 232*b* use the voltages $V_B$ and $V_A$ as power supply voltages. Since only the level shifter 270*c* is enabled during a period from timing t4 to timing t5, the transistors 231*c* and 232*c* use the voltages $V_C$ and $V_B$ as power supply voltages. Since only the level shifter 270*d* is enabled during a period from timing t5 to timing t6, the transistors 231*d* and 232*d* use the voltages $V_D$ and $V_C$ as power supply voltages. Since only the level shifter 270*c* is enabled from timing t6, the transistors 231*c* and 232*c* use the voltages $V_C$ and $V_B$ as power supply voltages, and respectively output the drive signal COM-A.

Next, an operation of the pairs of transistors will be described by using an example in which the transistors 231*a* and 232*a* that operate in the first range are used. In the first range, only the level shifter 270*a* is enabled.

The operation will be schematically described as follows. If the voltage Out2 of the terminal N3 is lower than the voltage ($Vin-V_1$), the signal Gt1 goes to an L level and thereby the transistor 231*a* is turned on. Accordingly, the voltage Out2 (Out1) is controlled to be increased. Meanwhile, if the voltage Out2 increases to a voltage higher than or equal to the voltage ($Vin+V_2$), the signal Gt2 goes to an H level and thereby the transistor 232*a* is turned on. Accordingly, the voltage Out2 (Out1) is controlled to be decreased.

Detailed description will be made with reference to FIG. 13 and FIG. 14.

Figure 13:
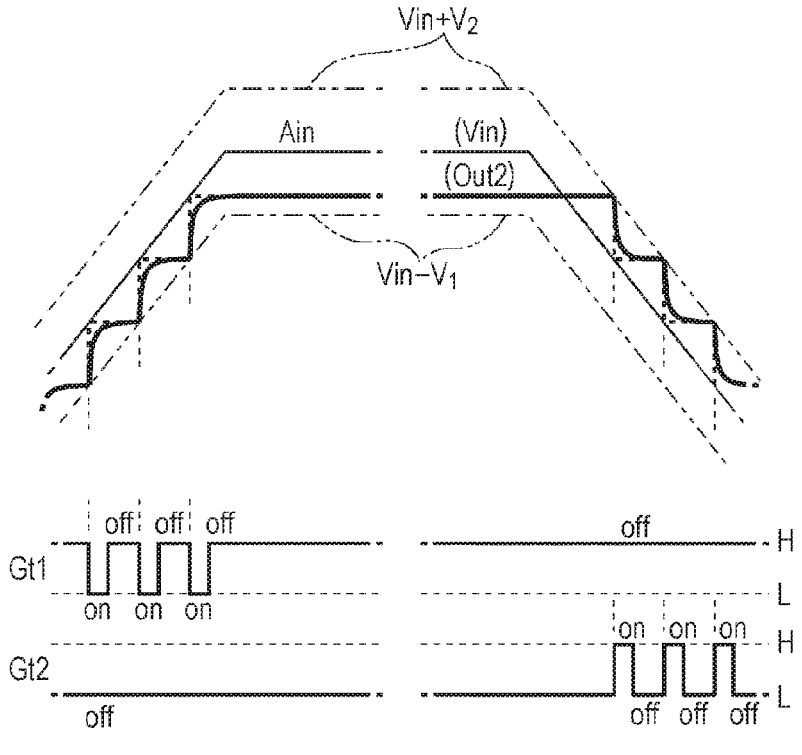
FIG. 13 is a diagram illustrating an operation of a unit circuit.
Figure 14:
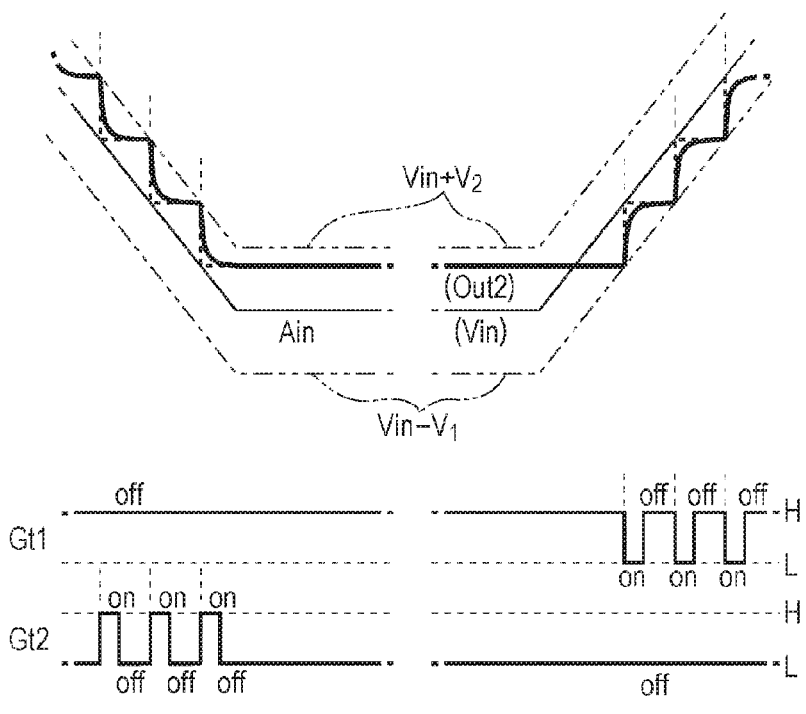
FIG. 14 is a diagram illustrating an operation of the unit circuit.

FIG. 13 and FIG. 14 illustrate changes of the voltage Out2 with respect to a change of the voltage Vin of the signal Ain. Since the signal Ain is a trapezoidal waveform, forms of a change of a voltage change rate (slope) are divided into four patterns as follows. That is, the four patterns include:

a change from rise to flat (first pattern), a change from flat to fall (second pattern), a change from fall to flat (third pattern), and a change from flat to rise (fourth pattern).

In the four patterns, it does not mean that the voltage Vin changes necessarily in that sequence.

The left column of FIG. 13 illustrates a waveform of the voltage Out2 when the voltage Vin changes in the first pattern.

If the voltage Vin rises, the voltage ($Vin-V_1$) also rise in accordance with the voltage Vin. When the voltage Out2 is lower than the increasing voltage ($Vin-V_1$) with respect to rising of the voltage Vin, the signal Gt1 goes to an L level, the transistor 231*a* is turned on, and thus the voltage Out2 rises. However, the voltage Out2 immediately rises to a voltage higher than or equal to the voltage ($Vin-V_1$), and thus the signal Gt1 goes to an H level, and the transistor 231*a* is turned off. When the voltage Vin rises, such an operation is repeated, and thus the voltage Out2 ideally changes in a stepwise shape as illustrated by a dashed line in the figure. However, when viewed from the terminal N2 toward an output side, a type of integral circuit is formed by resistance or inductance components through which the drive signal COM-A is transmitted, the capacitor C0, and the piezoelectric element Pzt or the like which is a load, and thus an actual waveform of the voltage Out1 becomes gentle with respect to the stepwise waveform. For this reason, the voltage Out1 also becomes gentle with respect to the voltage Out2.

When rising of the voltage Vin is stopped and the voltage Vin becomes flat, the voltage ($Vin-V_1$) also becomes flat, and thus the voltage Out1 is retained in accordance with the piezoelectric element Pzt, the capacitor C0, or the like including capacitance that is a load as a value when the transistor 231*a* is finally turned off from a turn-on state. Accordingly, the voltage Out2 is also retained.

The right column of FIG. 13 is a diagram illustrating a waveform of the voltage Out2 when the voltage Vin changes in the second pattern.

If the voltage Vin changes from flat to fall, the voltage ($Vin+V_2$) also falls in accordance with the voltage Vin. If the voltage Out2 which is retained flat becomes higher than or equal to the voltage ($Vin+V_2$) which falls, the transistor 232*a* is turned on, and thus the voltage Out2 decreases, but immediately decreases to a voltage lower than the voltage ($Vin+V_2$). Accordingly, the transistor 232*a* is turned off. When the voltage Vin falls, such an operation is repeated, and thus the voltage Out2 ideally changes in a stepwise shape as illustrated by a dashed line in the figure, but actual waveform of the voltage Out2 becomes gentle by the integral circuit.

The left column of FIG. 14 is a diagram illustrating a waveform of the voltage Out2 when the voltage Vin changes in the third pattern. If the voltage Vin changes from fall to flat, the voltage ($Vin+V_2$) also becomes flat, and thus the voltage Out2 is finally retained as a value when the transistor 232*a* is turned off from a turn-on state.

The right column of FIG. 14 is a diagram illustrating a waveform of the voltage Out2 when the voltage Vin changes in the fourth pattern. If the voltage Vin changes from flat to rise, the ($Vin-V_1$) also rises in accordance with the voltage Vin. The voltage Out2 which is retained flat becomes lower than the voltage ($Vin-V_1$) which rises, with respect to the rising of the voltage Vin. The subsequent operation is the same as the operation when the voltage Vin rises in the first pattern.

Hence, if the voltage Vin is in the first range, the voltage Out2 is controlled to follow the voltage Vin, and thus, in the end, the voltage Out1 is controlled to be 10 times the voltage Vin.

If the voltage Vin is in the second range, the level shifter 270*b* is enabled, and thus, in the same manner, the voltage Out1 is controlled to be 10 times the voltage Vin in accordance with the transistors 231*b* and 232*b*.

If the voltage Vin is in the third range, the level shifter 270*c* is enabled, and thus, the voltage Out1 is controlled to be 10 times the voltage Vin in accordance with the transistors 231*c* and 232*c*. In addition, If the voltage Vin is in the fourth range, the level shifter 270*d* is enabled, and thus, the voltage Out1 is controlled to be 10 times the voltage Vin in accordance with the transistors 231*d* and 232*d*.

As described above, the description is focused on the form in which a change rate (slope) of the voltage Vin is changed, but the voltage Vin can change (transition) across a region adjacent to each other in the first range to the fourth range. For example, referring to FIG. 12, the voltage Vin is transitioned from the third range to the second range at timing t1.

If the voltage Vin is in the third range, the level shifter 270*c* is enabled, and thus the voltage Out1 is controlled to be 10 times the voltage Vin in accordance with the transistors 231*c* and 232*c*. When the voltage Vin is transitioned from the third range to the second range at timing t1, the level shifter 270*c* is disabled, the level shifter 270*b* is enabled, and thus the voltage Out1 which is continuous is controlled to be 10 times the voltage Vin in accordance with the transistors 231*b* and 232*b*.

Here, a case in which the voltage Vin is transitioned from the third range to the second range is described as an example, but the operation is also the same as in other cases. For example, if the voltage Vin is transitioned from the second range to the first range, the level shifter 270*b* is disabled, the level shifter 270*a* is enabled, and thus the voltage Out1 which is continuous is controlled to be 10 times the voltage Vin in accordance with the transistors 231*a* and 232*a*.

Here, the drive circuit 120*a* which outputs the drive signal COM-A is described, but the drive circuit 120*b* which outputs the drive signal COM-B performs the same operation, if it is noted that the drive signal COM-B has the trapezoidal waveform Bdp1 during a period T1 and has the trapezoidal waveform Bdp2 during a period T2.

Figure 15:
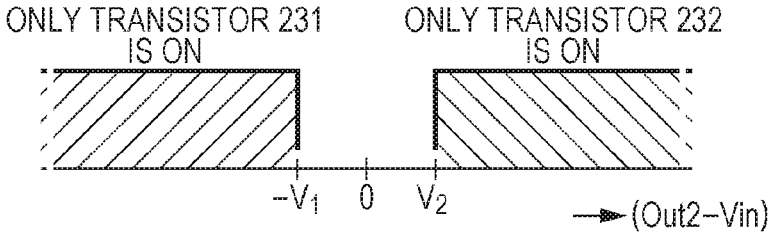
FIG. 15 is a diagram illustrating an operation of a transistor with regard to a relationship between an input signal and an output signal.

FIG. 15 is a diagram illustrating a region in which transistors 231 and 232 are turned on with regard to a change of a voltage (Out1−Vin).

Here, the transistors 231 and 232 are used for general description, in a case in which the transistors 231*a* and 232*a*, the transistors 231*b* and 232*b*, the transistors 231*c* and 232*c*, or the transistors 231*d* and 232*d* are not particularly limited to a voltage range.

As illustrated in FIG. 15, if the voltage (Out2−Vin) is lower than $-V_1$, only the transistor 231 is turned on, and if the voltage (Out2−Vin) is higher than or equal to $V_2$, only the transistor 232 is turned on.

Meanwhile, if the voltage (Out2−Vin) is higher than or equal to $-V_1$ and lower than $V_2$, both the transistors 231 and 232 are turned off. For this reason, a region (dead bandwidth) exists in which the voltage Out2 (Out1) does not change in the first range to the fourth range. Due to this dead bandwidth, the voltage Out2 has an error of maximum $V_1$ in a negative direction, and an error of maximum $V_2$ in a positive direction, with respect to the voltage Vin. If viewed from the voltage Out1 of the terminal N2, an error of 10 times a voltage change rate, that is, errors of maximum 10 $V_1$ in the negative direction, and maximum 10 $V_2$ in the positive direction, occur.

However, the error can be reduced depending on setting of the voltage $V_1$ of the reference power supply 211 and the voltage $V_2$ of the reference power supply 212. Specifically, if the voltages $V_1$ and $V_2$ are set to, for example, an error of 0.01 V, the error can be reduced to the extent that there is practically no problem with respect to the waveform of the drive signal COM-A which swings with an amplitude of approximately 40 V.

In the present embodiment, a configuration is used in which, in order to drive any one of the four pairs of transistors, the selector 280 selects one of the enabled level shifters 270*a*, 270*b*, 270*c*, and 270*d* in accordance with the data dA (dB), and the enabled level shifter level-shifts the signals Gt1 and Gt2 to supply to the pairs of transistors.

For this reason, in the present embodiment, one set of comparison units of the comparators 221 and 222 is sufficient, compared to a configuration in which a comparison unit is provided in accordance with each of the pairs of transistors.

In addition, in the present embodiment, a circuit which oscillates a triangular waveform or the like when an input signal is modulated, or a low pass filter for demodulation is not required, compared to a D-class amplification method, and thus it is possible to simplify a circuit configuration and to reduce power consumption by that amount.

Furthermore, if a voltage of the input signal is flat, the transistors 231*a*, 231*b*, 231*c*, 231*d*, 232*a*, 232*b*, 232*c*, and 232*d* are all turned off, and thus a problem in which power is wastefully consumed by switching is not created.

Next, a role of the capacitors C1 and C2 will be described.

As described above, power of the comparators 221 and 222 has a small swing of approximately 4 V. Therefore, breakdown voltages of transistors or the like which configure the comparators 221 and 222 are also designed to be low in accordance with the power with a low swing. Meanwhile, the voltage Out1 of the terminal N2 has a high swing which is approximately maximum 40 V. Hence, the voltage Out1 with a high swing is not able to be directly fed back to the comparators 221 and 222 with a low breakdown voltage, and thus, the present embodiment has a configuration in which the voltage Out1 is divided by the resistor elements R1 and R2, and the voltage which is obtained by dividing the divided voltage Out1 is fed back to the comparators 221 and 222.

Circuit configurations of the comparators 221 and 222 are well known, and in detail, an input terminal (+) thereof is coupled to a gain of one transistor of transistors which are configuration elements. Therefore, considerable capacitance components are parasitic on the input terminal (+), and thus, a CR filter is formed by the parasitic capacitance components and the resistor elements R1, and a first delay occurs on a feedback path. The delay is temporally lengthened thereby decreasing a switching frequency of the pair of transistors, and waveform reproducibility of the drive signal COM-A (COM-B) is deteriorated.

Here, in the present embodiment, the capacitors C1 and C2 are provided, and the differentiation and integration circuit is configured by coupling the capacitor C1 in parallel with the resistor element R2 and coupling the capacitor C2 in parallel with the resistor element R1. That is, a configuration is provided in which the resistor elements R1 and R2 are used for dividing a voltage and a phase delay on the feedback path is compensated for by the differentiation and integration circuit including the capacitors C1 and C2.

A specific example of characteristics of the differentiation and integration circuit will be described.

Figure 16:
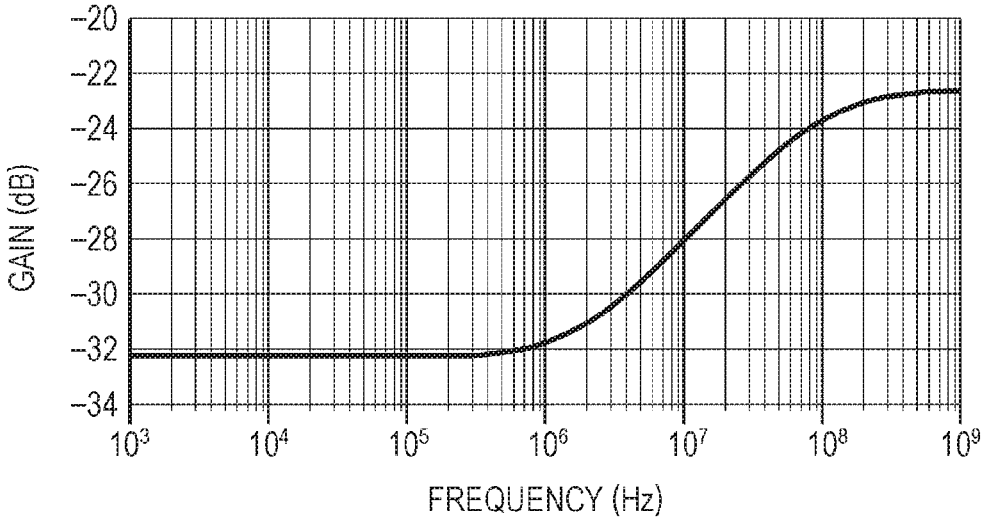
FIG. 16 is a diagram illustrating gain characteristics of a differentiation and integration circuit.

FIG. 16 is a diagram illustrating an example of frequency-gain characteristics of the differentiation and integration circuit.

Figure 17:
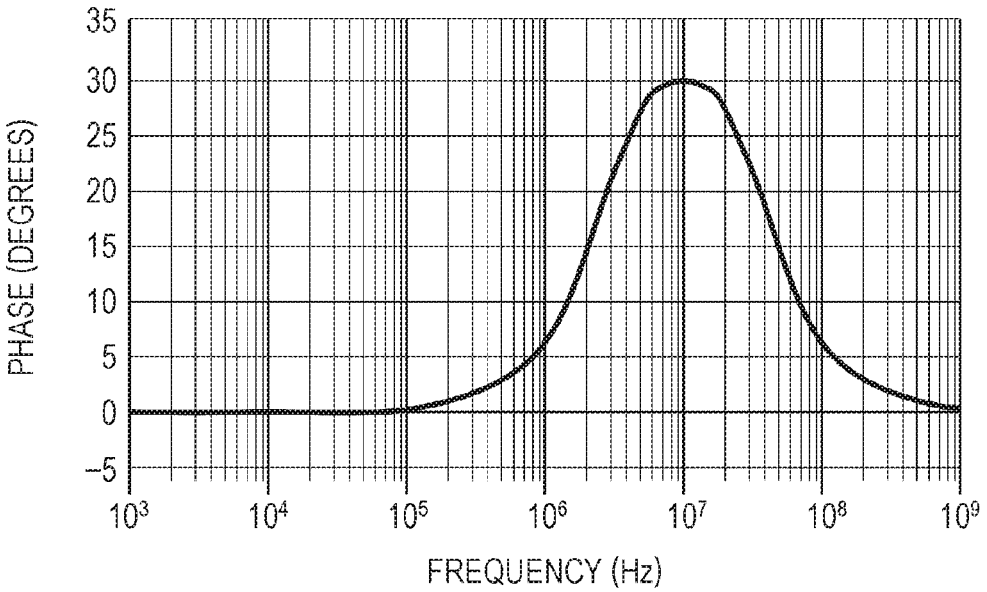
FIG. 17 is a diagram illustrating phase characteristics of the differentiation and integration circuit.

FIG. 17 a diagram illustrating frequency-phase characteristics of the differentiation and integration circuit.

In FIG. 17, a vertical axis denotes a phase (degrees), and illustrates that the phase relatively progresses by using the periphery of a frequency of 10 MHz as a peak value. Hence, a phase progresses over a frequency band in which the pair of transistors in the differentiation and integration circuit, and thus, the phase delay on the feedback path is compensated for.

In the aforementioned example, the voltage Out1 on the terminal N2 is fed back to the terminal N3 by being dropped to 1/10 times, and thus, a resistance ratio between the resistor elements R1 and R2 are 9:1, but in the description of characteristics thereof, a resistance ratio is 40:1, as will be described below. Accordingly, gain of the differentiation and integration circuit is −32.25 dB (0.0244 times) at a time period in which the pair of transistors is not switched.

Next, characteristics of the differentiation and integration circuit will be described.

Figure 18:
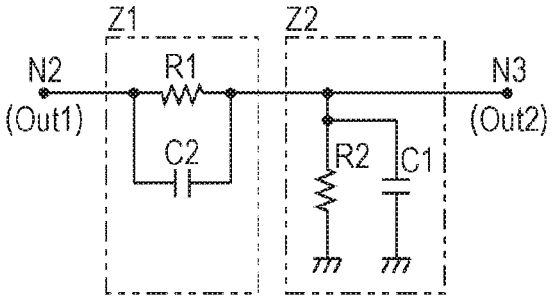
FIG. 18 is a diagram illustrating characteristics of the differentiation and integration circuit.

If the differentiation and integration circuit of FIG. 10 is rewritten such an input side thereof is located on the left side and an output side thereof is located on the right side, the differentiation and integration circuit can be represented by parallel coupling of the resistor element R1 and the capacitor C2 and parallel coupling of the resistor element R2 and the capacitor C1, as illustrated in FIG. 18.

A parallel impedance Z1 of the resistor element R1 and the capacitor C2 can be represented by following Formula (1).

$$Z1 = \frac{1}{\frac{1}{R1} + j\omega C2} = \frac{1}{1 + j\omega R1C2} \tag{1}$$

In addition, a parallel impedance Z2 of the resistor element R2 and the capacitor C1 can be represented by following Formula (2).

$$Z2 = \frac{1}{\frac{1}{R2} + j\omega C1} = \frac{1}{1 + j\omega R2C1} \tag{2}$$

A gain G of the differentiation and integration circuit which has the terminal N2 as an input and has the terminal N3 as an output can be represented by following Formula (3).

$$G = \frac{Out2}{Out1} = \frac{Z2}{Z1 + Z2} = \frac{1}{\frac{Z1}{Z2} + 1} = \frac{1}{\frac{R1(1 + j\omega R2C1)}{R2(1 + j\omega R1C2)} + 1} \tag{3}$$

An imaginary part of Formula (3) is removed in R2C1=R1C2, and thereby following Formula (4) can be obtained.

If R2C1=R1C2

$$G = \frac{R2}{R1 + R2} \tag{4}$$

The gain G represented by Formula (4) is obtained from division according to the resistor elements R1 and R2, and in order to decrease the voltage Out1 more than the voltage Out2, the resistor elements need to be set to R1>R2.

According to the present embodiment, the delay which occurs due to a feedback path from the terminal N2 to the terminal N3 through the resistor element R1, the comparator 221, and the capacitance components that are parasitic in the comparators 221 is compensated for by the differentiation and integration circuit which is configured by the resistor element R1, the resistor element R2, and the capacitors C1 and C2. Accordingly, an operation frequency of the pair of transistors may not be decreased. Therefore, it is possible to prevent the waveform reproducibility of the drive signal COM-A (COM-B) from being deteriorated.

In addition, the capacitor C0 for preventing abnormal oscillation is coupled to the terminal N2, but the capacitor C0 becomes a load when viewed from the terminal N2, and thus, the capacitor C0 is one of causes of waste consumption of power. If capacitance of the capacitor C0 decreases, waste consumption of power can be reduced. However, there is a high possibility that abnormal oscillation occurs in a configuration in which the capacitors C1 and C2 do not exist. In contrast to this, according to the present embodiment, the abnormal oscillation is prevented from occurring by the differentiation and integration circuit including the capacitors C1 and C2, and thus, the capacitance of the capacitor C0 can be decreased. Accordingly, it is possible to reduce power consumption.

Figure 19:
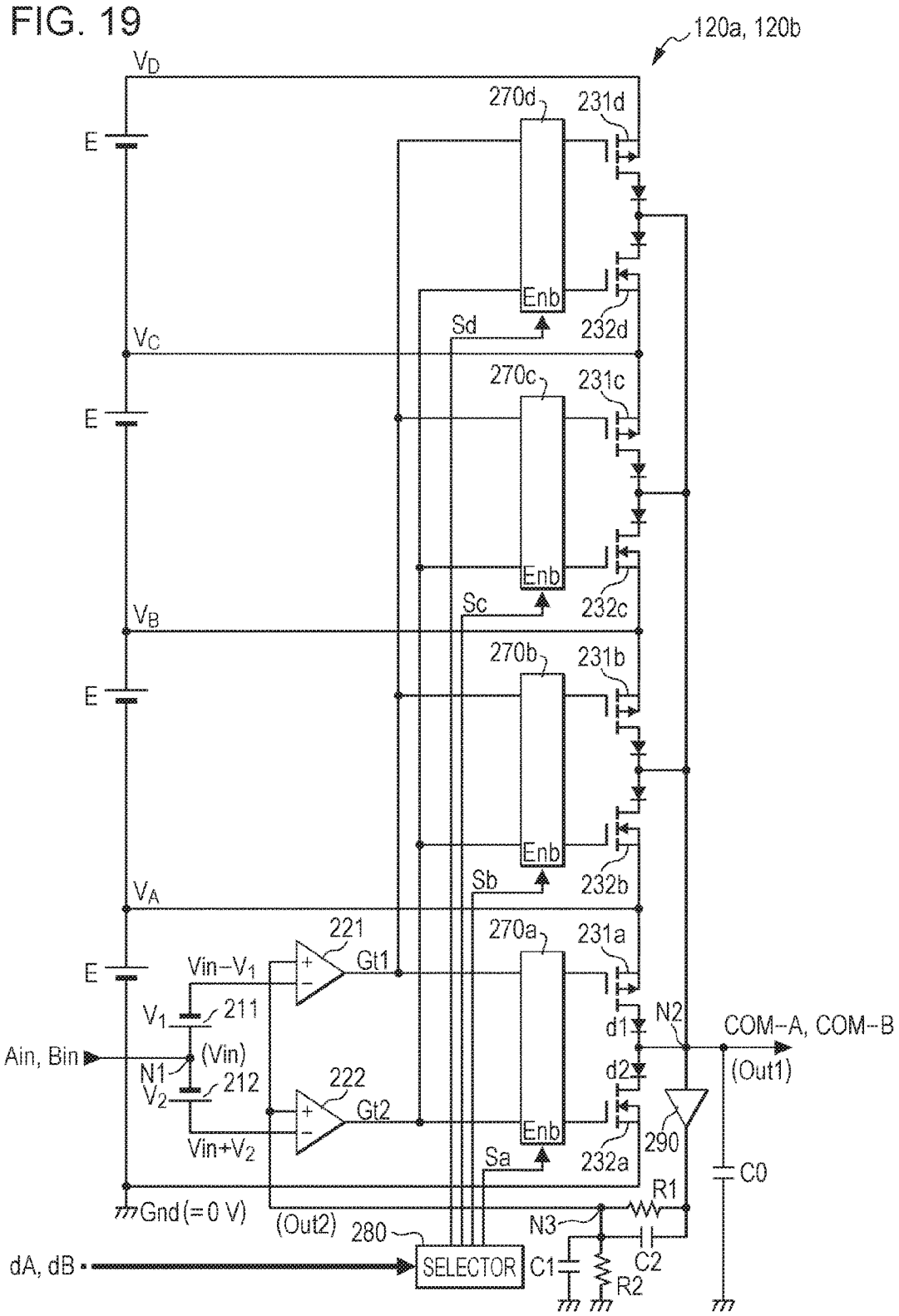
FIG. 19 is a diagram illustrating a configuration of the drive circuit according to an application and modification example.

FIG. 19 is a diagram illustrating a configuration of the drive circuit 120*a* (120*b*) according to a modification example of the embodiment. As illustrated in the figure, an operational amplifier 290 (buffer amplifier) which multiplies the voltage Out2 by a predetermined coefficient may be provided between the terminal N2 and the resistor element R1.

In this way, if the operational amplifier 290 is provided, it is possible to prevent the voltage Out2 of the terminal N2 from decreasing through the resistor elements R1 and R2 due to leakage.

In the embodiment, the transistors 231*a*, 231*b*, 231*c*, and 231*d* are set to a P-channel type, and the transistors 232*a*, 232*b*, 232*c*, and 232*d* are set to a N-channel type, but may be set to P-channel type or N-channel type.

In addition, the transistors are described as switching elements which are turned on or off, but the invention is not limited to this. For example, a configuration may be provided in which a drain current (resistance between source and drain) is changed in accordance with a voltage between a gate and a source. That is, a configuration may be provided in which an operation of the transistor 231 (232) is controlled by the signal Gt1 (Gt2).

In addition, the reference power supplies 211 and 212, the comparators 221 222, the level shifters 270*a*, 270*b*, 270*c*, and 270*d*, and the selector 280 may be integrated into a semiconductor device. In other words, the reference power supply E, the transistors 231*a*, 231*b*, 231*c*, 231*d*, 232*a*, 232*b*, 232*c*, and 232*d* (including diodes d1 and d2 for preventing reverse current) may be configured by external components.

In the embodiment, the voltage Vin is offset by the reference power supply 211 by the voltage $V_1$, and is offset by the reference power supply 212 by the voltage $V_2$, but since two voltages which are obtained by offsetting the voltage Vin (or the voltage Out1 as illustrated below) in vertical direction may be able to obtain, a configuration for the offset is not limited to elements such as a power supply (battery). For example, multiple combinations of the elements such as diodes or resistors may be used as follows.

Figure 20:
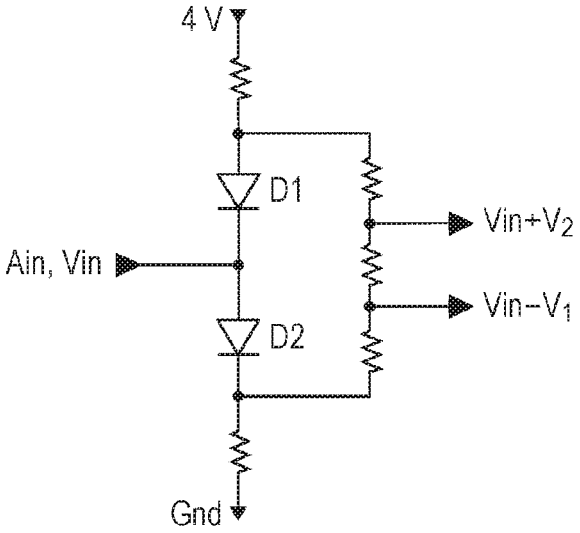
FIG. 20 is a diagram illustrating another example of a first offset unit and a second offset unit.

FIG. 20 is a diagram illustrating a configuration example (another example of a first offset unit and a second offset unit) for obtaining the voltages ($Vin+V_2$) and ($Vin-V_1$) which are obtained by offsetting the voltage Vin in a vertical direction.

In this example, the voltages ($Vin-V_1$) and ($Vin+V_2$) can be obtained by resistance-dividing voltages from a voltage which is obtained by offsetting the voltage Vin in a high side by a forward voltage of the diode D1, to a voltage which is obtained by offsetting the voltage Vin in a low side by a forward voltage of the diode D2.

In addition, the drive circuit 120*a* (120*b*) according to the embodiment has a configuration in which the comparator 221 discriminates whether the voltage Out2 is higher than or equal to the voltage ($Vin-V_1$) or lower than the voltage ($Vin-V_1$).

That is, a configuration is used in which the comparator 221 discriminates whether $Out2 \geq Vin-V_1$ or $Out2 < Vin-V_1$.

Here, the inequality can be changed to $Out2+V_1 \geq Vin$ or $Out2+V_1 < Vin$, and thus the comparator 221 may discriminate whether the voltage ($Out2+V_1$) is higher than or equal to the voltage Vin or lower than the voltage Vin.

In addition, the inequality can also be changed to $Out+V_1/2 \geq Vin-V_1/2$, or $Out+V_1/2 < Vin-V_1/2$.

For this reason, the comparator 221 may discriminate whether the voltage ($Out2+V_1/2$) is higher than or equal to the voltage ($Vin-V_1/2$) or lower than the voltage ($Vin-V_1/2$).

The point is that a configuration may be provided in which the comparator 221 offsets at least one of the voltage Vin that is an input signal and the voltage Out2 based on the drive signal of an output, and compares voltages in which the one is relatively offset to the other by the voltage $V_1$.

In the same manner, a configuration is used in which the comparator 222 discriminates whether $Out2 \geq Vin+V_2$ or $Out2 < Vin+V_2$.

Here, the inequality can be changed to $Out2-V_2 \geq Vin$ or $Out2-V_2 < Vin$, and thus the comparator 222 may discriminate whether the voltage ($Out2-V_2$) is higher than or equal to the voltage Vin or lower than the voltage Vin.

In addition, the inequality can also be changed to $Out2-V_2/2 \geq Vin+V_2/2$, or $Out2-V_2/2 < Vin+V_2/2$.

For this reason, the comparator 222 may discriminate whether the voltage ($Out2-V_2/2$) is higher than or equal to the voltage ($Vin+V_2/2$) or lower than the voltage ($Vin+V_2/2$).

The point is that a configuration may be provided in which the comparator 222 offsets at least one of the voltage Vin that is an input signal and the voltage Out2 based on the drive signal of an output, and compares voltages in which the one is relatively offset to the other by the voltage $V_2$.

In the embodiment, a configuration is used in which the selector 280 of the drive circuit 120*a* (120*b*) discriminates whether or not the voltage Vin is included in any one of the first range to the fourth range in accordance with the data dA (dB), and the signal Ain (Bin) which is an output signal of the DAC 113*a* (113*b*) may be used to discriminate.

For this reason, "in accordance with the voltage Vin (in accordance with input signal)" is synonymous to that discriminations are respectively made (the pair of transistors is selected) in accordance with the data dA (dB) and in accordance with a signal which is obtained by converting the data dA (dB) into an analog signal.

In addition, discrimination may be made by weighting two signals of the signals Ain (Bin) which are obtained by converting data dA (dB) and the data dA (dB) into analog data, for combination.

In the embodiment, the level shifters in the drive circuit 120*a* (120*b*), and the sets of the pairs of transistors are respectively set to "4", but may be set to "1" and may be set to be equal to or higher than "2". As the number of sets increases, the power supply voltage decreases, and thus, a transistor with a lower breakdown voltage can be used.

In addition, in the embodiment, a configuration is used in which the voltages $V_A$, $V_B$, $V_C$, and $V_D$ are output from a reference power supply which outputs the voltage E and are coupled in four-stage-series (refer to FIG. 11), and thus a difference between a high side voltage and a low side voltage of each voltage set is set to the voltage E (=10.5 V), but may be configured to be not set.

In addition, the voltage range may partially overlap in a region adjacent to each other among the first range to the fourth range. For example, the first range is set to voltages higher than or equal to zero volts and lower than a voltage ($V_A+\alpha$), the second range is set to voltages higher than or equal to a voltage ($V_A-\alpha$) and lower than a voltage ($V_B+\alpha$), the third range is set to voltages higher than or equal to a voltage ($V_B-\alpha$) and lower than a voltage ($V_C$+a), the fourth range is set to voltages higher than or equal to a voltage ($V_C-\alpha$) and lower than the voltage $V_B$, and the voltages may respectively overlap each other by $\pm\alpha$ around the voltages $V_A$, $V_B$, and $V_C$.

In addition, in the embodiment, a liquid ejecting apparatus is described as a printing apparatus, but the liquid ejecting apparatus may be a three-dimensional shaping apparatus which shapes a three-dimensional image by ejecting liquid, a textile dyeing apparatus which dyes textile by ejecting liquid, or the like.

In addition, in the embodiment, an example in which the piezoelectric element Pzt which ejects ink is used as a drive target of the drive circuit 120*a* (120*b*) is described, but when it is considered that the drive circuit 120*a* is separated from the printing apparatus, the drive target is not limited to the piezoelectric element Pzt, and can be applied to, for example, an ultrasonic motor, a touch panel, an electrostatic speaker, or all of the load having a capacitive component such as a liquid crystal panel.

What is claimed is:

1. A liquid ejecting apparatus comprising:

an ejecting unit that includes a piezoelectric element which is displaced by application of a drive signal and ejects liquid according to displacement of the piezoelectric element;

a comparison unit that includes a first comparator and a second comparator, receives an input signal and a feedback signal based on the drive signal, and outputs a first control signal and a second control signal;

a pair of transistors that is configured by a first transistor which is controlled based on the first control signal and a second transistor which is controlled based on the second control signal, and outputs the drive signal from a coupling point of the first transistor and the second transistor;

an output capacitor that has one terminal coupled to the coupling point; and a differentiation and integration circuit that drops a voltage of the feedback signal and outputs a signal which is obtained by making a phase progress over a predetermined frequency band, as the feedback signal, wherein the first comparator compares a first comparison signal with a second comparison signal and outputs the first control signal, wherein the first comparison signal is a signal that is obtained by offsetting one of the input signal and the feedback signal, wherein the second comparator compares a third comparison signal with a fourth comparison signal and outputs the second control signal, and wherein the third comparison signal is a signal that is obtained by offsetting one of the input signal or the feedback signal.

2. The liquid ejecting apparatus according to claim 1, wherein the differentiation and integration circuit includes a first resistor, a second resistor, a first capacitor, and a second capacitor, wherein the first resistor and the second capacitor are electrically coupled in parallel with each other between an output node of the drive signal and an input node of the feedback signal to the comparison unit, and wherein the second resistor and the first capacitor are electrically coupled in parallel with each other between the input node and a power supplying line with a predetermined potential.

3. The liquid ejecting apparatus according to claim 2, wherein the first resistor has a resistance value greater than a resistance value of the second resistor.

4. The liquid ejecting apparatus according to claim 2, wherein a buffer amplifier is provided between the output node and the first resistor, and wherein the buffer amplifier multiplies a voltage of the output node by a predetermined coefficient and supplies the voltage of the multiplied value to the first resistor.

5. The liquid ejecting apparatus according to claim 1, wherein the second comparison signal is a signal that is obtained by offsetting the other of the input signal or the feedback signal by a voltage including zero, and wherein the fourth comparison signal is a signal that is obtained by offsetting the other of the input signal or the feedback signal by a voltage including zero.

6. The liquid ejecting apparatus according to claim 1, wherein the first transistor and the second transistor are field effect transistors.

7. The liquid ejecting apparatus according to claim 1, further comprising:

a first offset unit that decreases the input signal by a first voltage, or increases the feedback signal by the first voltage; and a second offset unit that increases the input signal by a second voltage, or decreases the feedback signal by the second voltage.

8. The liquid ejecting apparatus according to claim 1, wherein the first comparator sets the first control signal as a signal which turns on the first transistor, if a voltage of the feedback signal is lower than a voltage which is obtained by subtracting a voltage of the input signal by the first voltage, and wherein the second comparator sets the second control signal as a signal which turns on the second transistor, if the voltage of the feedback signal is equal to or higher than a voltage which is obtained by adding the second voltage to the voltage of the input signal.

9. A drive circuit, that drives a capacitive load in accordance with a drive signal, comprising:

a comparison unit that includes a first comparator and a second comparator, receives an input signal and a feedback signal based on the drive signal, and outputs a first control signal and a second control signal;

a pair of transistors that is configured by a first transistor which is controlled based on the first control signal and a second transistor which is controlled based on the second control signal, and outputs the drive signal from a coupling point of the first transistor and the second transistor;

an output capacitor that has one terminal coupled to the coupling point; and a differentiation and integration circuit that drops a voltage of the feedback signal and outputs a signal which is obtained by making a phase progress over a predetermined frequency band, as the feedback signal, wherein the first comparator compares a first comparison signal with a second comparison signal and outputs the first control signal, wherein the first comparison signal is a signal that is obtained by offsetting one of the input signal and the feedback signal, wherein the second comparator compares a third comparison signal with a fourth comparison signal and outputs the second control signal, and wherein the third comparison signal is a signal that is obtained by offsetting one of the input signal or the feedback signal.

10. A head unit comprising:

a piezoelectric element that is displaced by application of a drive signal which is performed by a drive circuit; and an ejecting unit that ejects liquid in accordance with displacement of the piezoelectric element, wherein the drive circuit includes, a comparison unit that includes a first comparator and a second comparator, receives an input signal and a feedback signal based on the drive signal, and outputs a first control signal and a second control signal, a pair of transistors that is configured by a first transistor which is controlled based on the first control signal and a second transistor which is controlled based on the second control signal, and outputs the drive signal from a coupling point of the first transistor and the second transistor, an output capacitor that has one terminal coupled to the coupling point, and a differentiation and integration circuit that drops a voltage of the feedback signal and outputs a signal which is obtained by making a phase progress over a predetermined frequency band, as the feedback signal, wherein the first comparator compares a first comparison signal with a second comparison signal and outputs the first control signal, wherein the first comparison signal is a signal that is obtained by offsetting one of the input signal or the feedback signal, wherein the second comparator compares a third comparison signal with a fourth comparison signal and outputs the second control signal, and wherein the third comparison signal is a signal that is obtained by offsetting one of the input signal or the feedback signal.

* * * * *